US007201615B2

(12) United States Patent
Kojima

(10) Patent No.: US 7,201,615 B2
(45) Date of Patent: Apr. 10, 2007

(54) CONNECTOR ASSEMBLY WITH TERMINAL RETENTION MEMBER

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/237,538

(22) Filed: Sep. 28, 2005

(65) Prior Publication Data

US 2006/0068647 A1 Mar. 30, 2006

(30) Foreign Application Priority Data

Sep. 28, 2004 (JP) ..... 2004-311535
Sep. 28, 2004 (JP) ..... 2004-311536
Sep. 29, 2004 (JP) ..... 2004-313091
Sep. 29, 2004 (JP) ..... 2004-313092

(51) Int. Cl.
*H01R 13/514* (2006.01)

(52) U.S. Cl. ..... 439/752

(58) Field of Classification Search ..... 439/752, 439/595, 871
See application file for complete search history.

(56) References Cited

U.S. PATENT DOCUMENTS 3,648,213 A 3/1972 Kobler
5,554,052 A 9/1996 Saijo et al.
5,839,923 A 11/1998 Yoshida
5,980,331 A 11/1999 Matsushita et al.
6,068,512 A * 5/2000 Sugie ..... 439/595
6,599,154 B2 * 7/2003 Sakurai et al. ..... 439/752
6,623,313 B1 9/2003 Ichida et al.
6,948,978 B2 * 9/2005 Itou et al. ..... 439/595
6,981,900 B2 * 1/2006 Sakurai et al. ..... 439/752.5
2003/0060075 A1 * 3/2003 Nakamura et al. ..... 439/345
2003/0157832 A1 * 8/2003 Tabata ..... 439/587
2003/0157835 A1 8/2003 Ishikawa et al.

FOREIGN PATENT DOCUMENTS

EP 0 548 961 B1 9/1995
FR 2 737 349 1/1997
FR 2 820 245 8/2002
JP 9-153386 6/1997

* cited by examiner

*Primary Examiner*—Tho D. Ta
*Assistant Examiner*—Vanessa Girardi
(74) *Attorney, Agent, or Firm*—Gerald E. Hespos; Anthony J. Casella

(57) ABSTRACT

A connector has a housing (10) with cavities (11) for receiving terminal fittings (30). Locks (15B) are formed unitarily with the housing and are cantilevered into the cavities (11). Deformation spaces (21) are formed adjacent the lock (15B) to accommodate resilient deformation of the locks (15B). Each lock (15B) has a reinforcing ribs (18) facing into the deformation space (21). Additionally, a wall (41) of the deformation space (21) has an escaping portion (47) for accommodating the reinforcing rib (18). The reinforcing ribs (18) strengthen the locks (15B) and escaping portions (47) prevent enlargement of the housing (10).

18 Claims, 32 Drawing Sheets

CONNECTOR ASSEMBLY WITH TERMINAL RETENTION MEMBER

BACKGROUND OF THE INVENTION

1. Field of the Invention

The invention relates to a connector and to a connector assembly.

2. Description of the Related Art

EP 0 548 961 discloses a connector with a housing that has cavities for receiving terminal fittings. Locks are formed on inner walls of the cavities to engage the terminal fittings. The locks can be thinned to reduce the size of the connector. However, the thinner locks are less rigid and may hold the terminal fittings less securely.

EP 0 548 961 discloses another connector with a housing that has cavities for receiving terminal fittings. Locks are formed on inner walls of the cavities to engage the terminal fittings. A jig can be inserted through a jig insertion opening in the front of the housing and into a deformation space for the lock. The jig can deform the lock resiliently in a direction to disengage the lock from the terminal fitting. The locks, the deformation spaces and the jig insertion openings all become smaller if the connector is miniaturized. As a result, the jig may be difficult to insert through the jig insertion opening.

Japanese Unexamined Patent Publication No. H09-153386 discloses a connector with female terminal fittings. Each female terminal fitting has a tube for connection with a male terminal fitting and a barrel for connection with a wire. The tube and the barrel have substantially equal heights. Accordingly, the height of cavities for accommodating the terminal fittings is adjusted to the height of the barrels over the entire length.

Terminal fittings become shorter as the miniaturization of connectors progresses. Thus, barrels of a miniaturized connector may be taller than the tubes due to the diameter of wires to be connected. The cavities have a uniform height that conforms to the height of the barrels as before. However, a part of a housing corresponding to the tubes is increased uselessly and does not contribute to the miniaturization.

The height of the cavities could be increased in accordance with those of the barrels and the tubes. Then, the outer surfaces of the housing would be stepped at a boundary between a part corresponding to the barrels and a part corresponding to the tubes. The height of the connector can be made shorter than before if the housing is fit into a receptacle of a male housing up to the part corresponding to the tubes. However, the depth into the receptacle along a connecting direction is restricted to the depth up to the part corresponding to the tubes and an area before the barrels. This design constraint hinders efforts to shortening the length of the connector when the two housings are mated.

The connector of EP 0 548 961 is shown in FIG. 32 herein and has a housing 150. The housing 150 has locks 151 and deformation spaces 152 below the locks 151 have heights to permit deformation of the locks 151 within their resiliency limit. The deformation spaces 152 hinder efforts to shorten the height of the housing 150. The locks 151 could be walls of cavities 153. Thus, the locks 151 could be exposed at outer surfaces of the housing 150 and could resiliently deform in a manner to project out of the housing 150. With such a construction, the height of the connector can be shortened since it is not necessary to provide the deformation spaces in the housing 150. However, a separate means must be provided to prevent excessive deformations of the locks 151 in such a case.

The present invention was developed in view of the above problem, and an object thereof is to improve the operability of a connector, particularly while allowing a miniaturization of a connector.

SUMMARY OF THE INVENTION

The invention relates to a connector that has a housing formed with at least one cavity for receiving a terminal fitting. A lock extends along an inner wall of the cavity and is resiliently deformable towards a deformation space. The lock interferes with the terminal fitting as the terminal fitting is inserted into the cavity, and hence the lock deforms away from the cavity. The lock then restores resiliently to engage the properly inserted terminal fitting and to retain the terminal fitting in the cavity. The lock has a reinforcing rib that projects from a surface of the lock that faces towards the deformation space. At least one escaping portion is formed in a surface of a wall facing the deformation space and at a position for accommodating the reinforcing rib.

The reinforcing rib increases the rigidity of the lock. Thus, the lock retains the terminal fitting more reliably. Further, the reinforcing rib can be accommodated into the escaping portion. Accordingly, the connector is not enlarged significantly along the deforming direction of the lock.

The deformation space preferably makes an opening in an outer surface of the housing. A protector preferably is mounted to the housing at the opening of the deformation space. The protector preferably has a wall that enters a deformation area for the lock.

The housing is made smaller along the deforming direction of the lock by forming the deformation space with the opening in the outer surface of the housing and by providing the wall of the protector separate from the housing. The wall of the protector enters the deformation area for the lock when the protector mounted. Thus, the housing is smaller along the deforming direction of the lock as compared to a case where a space is defined for the resilient deformation of the lock. Further, the opening of the deformation space in the outer surface of the housing preferably is closed by the wall of the protector. Thus, external matter cannot enter into the opening of the deformation space.

The wall of the protector preferably contacts the lock to prevent deformation of the lock towards the deformation space when the protector is mounted to the housing. Thus, the terminal fitting is retained more reliably.

The protector preferably includes a terminal lock for entering the cavity and engaging the terminal fitting. Thus, the terminal fitting is locked more securely.

The escaping portion preferably penetrates the wall of the housing. Thus, the housing is smaller along the deforming direction of the lock as compared to a case where the escaping portion is merely a recess.

A jig insertion opening preferably is formed in a front wall of the housing and can receive a jig for deforming the lock away from the terminal fitting and thereby freeing the terminal fitting from the lock. An edge of the jig insertion opening corresponding to the deformation space in the front wall of the housing preferably is formed by a member separate from the housing and is displaceable relative to the housing to widen the jig insertion opening.

The opening forming member can be displaced in a direction to widen the jig insertion opening for facilitating insertion of the jig. Further, the opening forming member can be displaced in a direction to narrow the jig insertion opening when it is not necessary to insert the jig. Thus external matter cannot enter through the jig insertion opening.

The opening forming member preferably has a terminal lock that can enter the terminal cavity. The terminal lock is engageable with the terminal fitting to retain the terminal fitting when the opening forming member is at the position to narrow the jig insertion opening. The terminal lock disengages the terminal fitting when the opening forming member is at the position to widen the jig insertion opening. With this design, it is unnecessary to perform separate operations of displacing the opening forming member and moving the terminal lock. Thus, operability is better.

The opening forming member preferably contacts the lock to prevent resilient deformation of the lock towards the deformation space. Thus, the reliability of retaining the terminal fitting is improved.

The opening forming member preferably is the protector.

The housing is made smaller along the deforming direction of the lock by forming the opening in the outer surface of the housing and by providing the wall separate from the housing. The wall faces the deformation space and enters the deformation area for the lock. Thus, the housing is smaller along the deforming direction of the lock, as compared to a case where a space necessary for deforming the lock is kept defined. Further, the opening of the deformation space in the outer surface of the housing is closed by the wall of the protector. Thus, external matter will not enter the opening of the deformation space.

The invention also relates to a connector assembly that has at least one terminal fitting with a terminal connecting portion for connection with a mating terminal fitting. The terminal fitting also has a barrel behind the terminal connecting portion for connection with a wire. The barrel has a larger height dimension than the terminal connecting portion. The connector assembly also has a first housing for receiving the terminal fitting. The first housing has a section for accommodating the terminal connecting portion of the terminal fitting, a bulging section for accommodating the barrel and a step between the two sections. The connector assembly also has a second housing with a receptacle for receiving the first housing. An escaping portion is formed at an opening edge of the receptacle for receiving the bulging section when the housings are connected.

The outer surfaces of the housing could have a substantially uniform height. However, the cavity of the subject invention has heights that conform with the height along the terminal fitting. Thus, the bulge is formed on the first housing at the part corresponding to the barrel. As a result, the receptacle of the second housing has a height necessary to receive the part of the first housing corresponding to the terminal connecting portion. Therefore, the height of the connector can be reduced.

The bulge can be fit into the escaping portion of the receptacle when the two housings are connected. Thus, the length of the connector can be shortened in a connected state.

A surface of the receptacle where the escaping portion is formed preferably is substantially flush with the outer surface of the bulge when the two housings are connected.

The escaping portion preferably penetrates the wall of the opening edge portion of the receptacle in the thickness direction. Accordingly, the height of the connector is reduced further as compared to a case where the escaping portion is a recess formed in the inner surface of the receptacle.

The housing preferably has a lock for engaging the terminal fitting. The connector may further have a retainer mountable to the housing and engageable with the terminal fitting to achieve redundant locking. The retainer is movable between a partial locking position where the terminal fitting is insertable into and withdrawable from the cavity and a full locking position where the retainer engages the terminal fitting. The retainer includes a terminal locking portion for locking the terminal fitting and an excessive deformation preventing portion at a resiliently deforming side of the lock for preventing excessive deformation of the lock when the retainer is at the partial locking position.

The absence of the wall at the deforming side of the lock creates the potential that the lock may be deformed excessively. However, the excessive deformation preventing portion prevents the excessive deformation of the lock.

The retainer preferably includes a terminal lock for locking the terminal fitting and a lock protector extending from the terminal lock substantially along the outer exposed surface of the lock. The lock protector substantially covers the lock along the longitudinal direction of the lock to achieve good overall operability.

The excessive deformation preventing portion and/or the lock protector preferably are in a resiliently deforming area of the lock to prevent deformation of the lock when the terminal lock of the retainer engages the terminal fitting.

The excessive deformation preventing portion and/or the lock protector preferably have a reinforcement.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
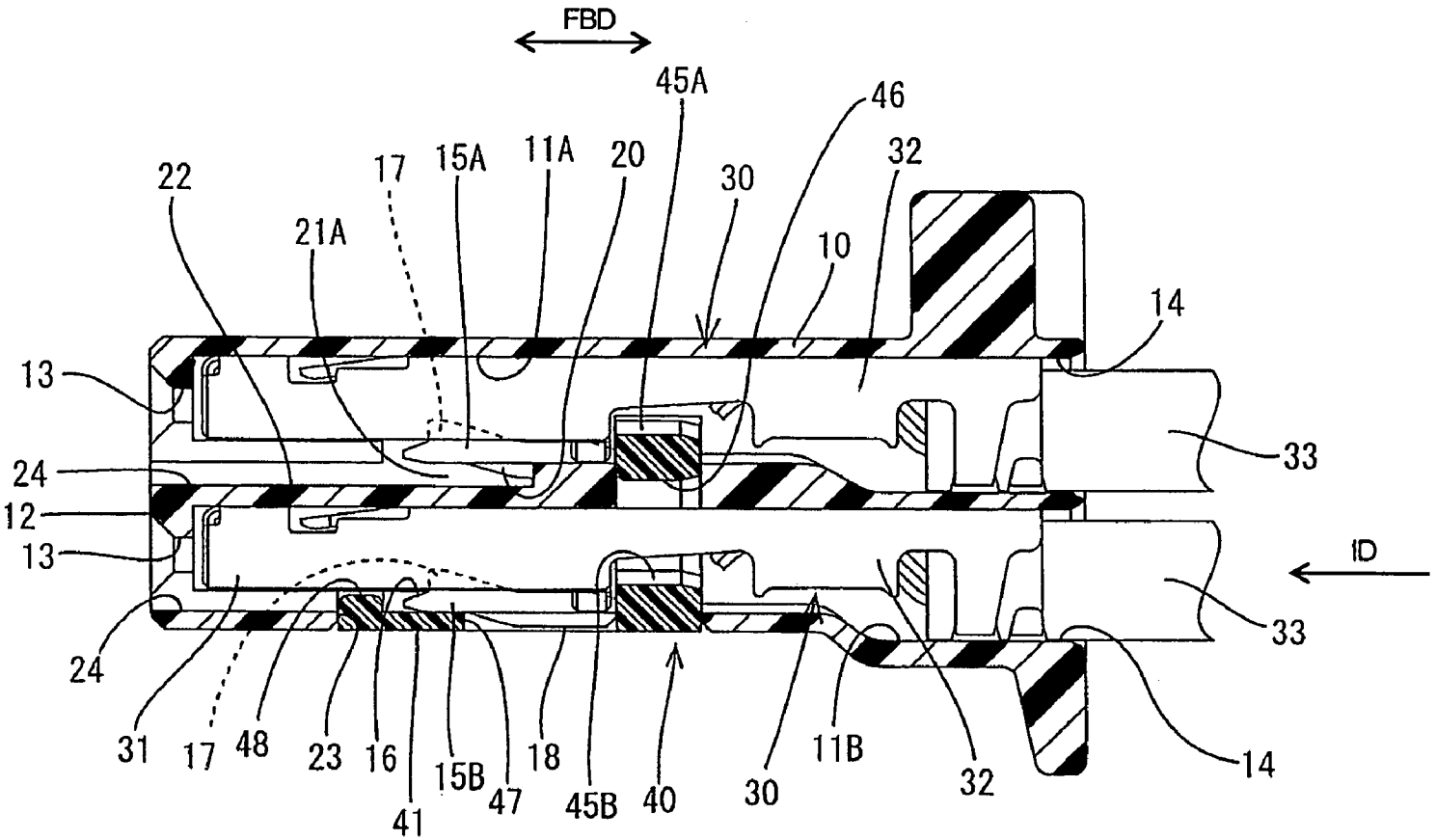
FIG. 1 is a longitudinal section showing a state where a protecting member is at a full locking position in a first embodiment of the invention.
Figure 2:
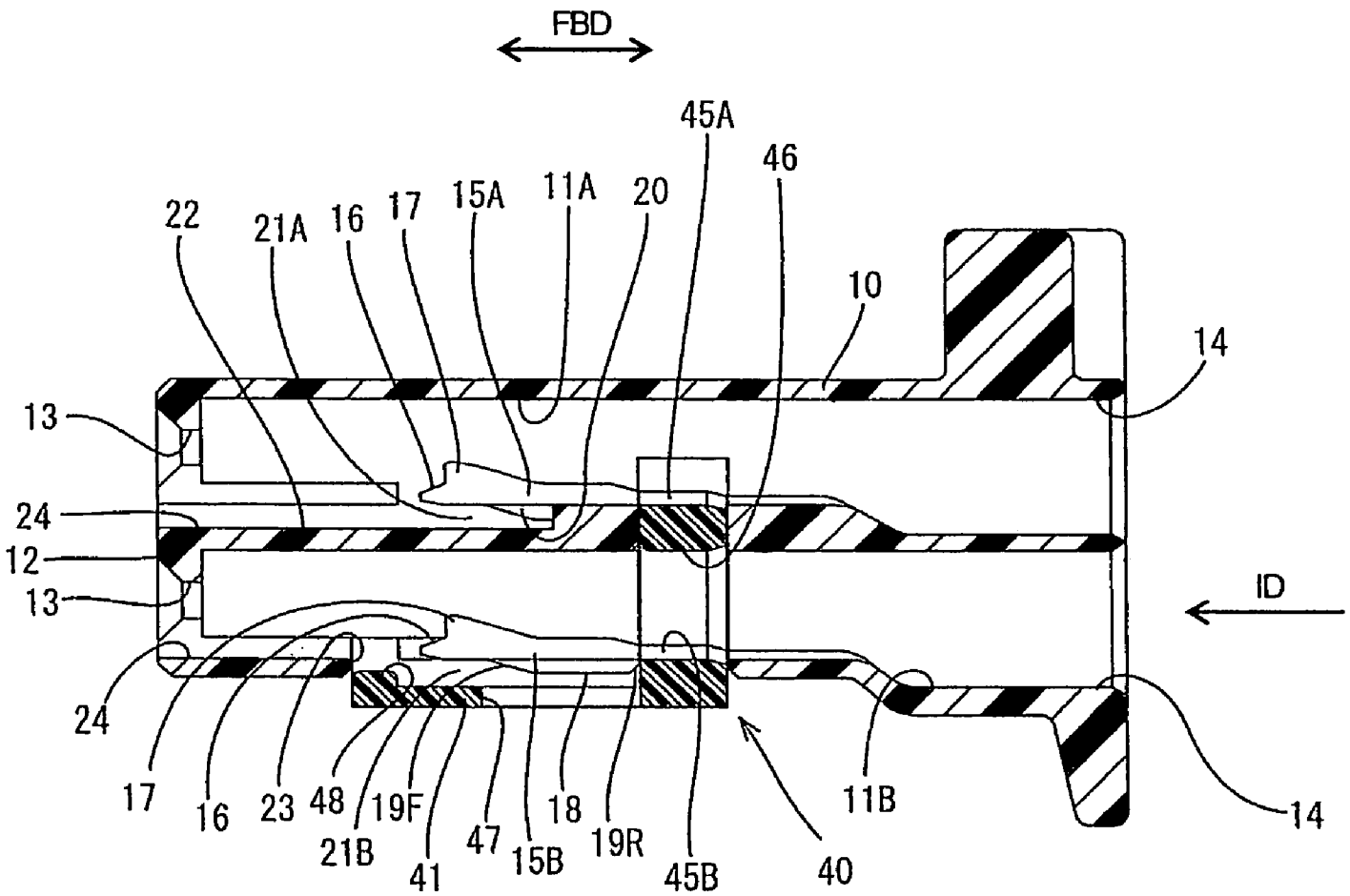
FIG. 2 is a longitudinal section showing a state where the protecting member is at a partial locking position.
Figure 3:
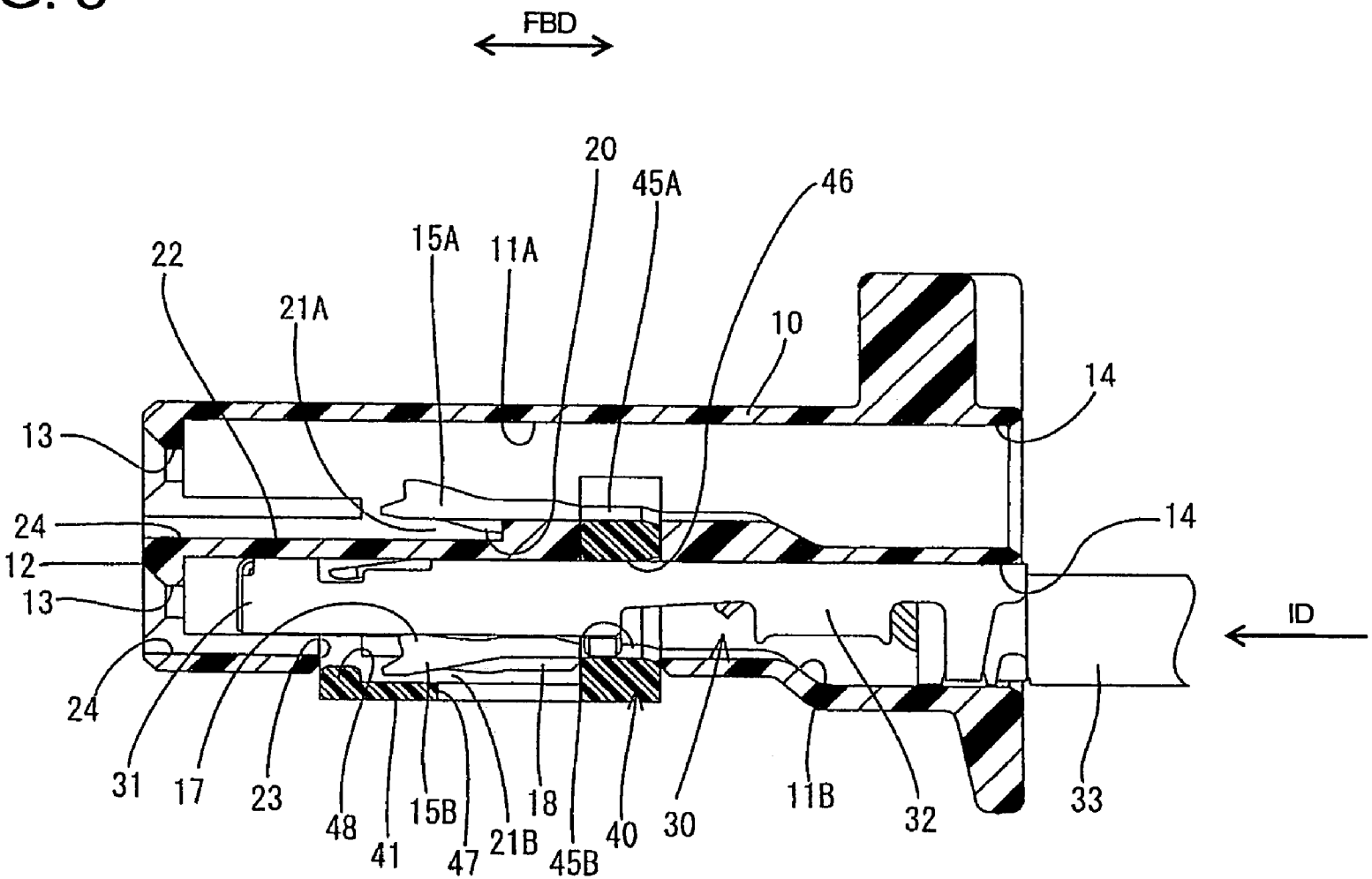
FIG. 3 is a longitudinal section showing the process of inserting a terminal fitting.
Figure 4:
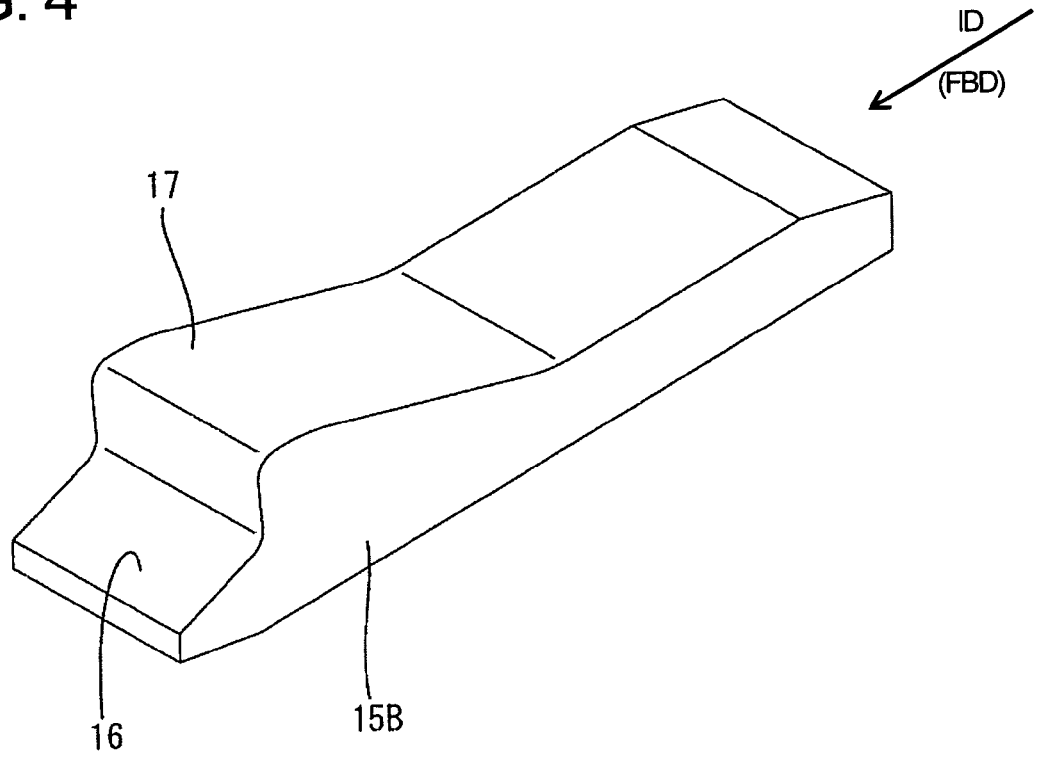
FIG. 4 is an enlarged perspective view of a locking portion at the lower stage.
Figure 5:
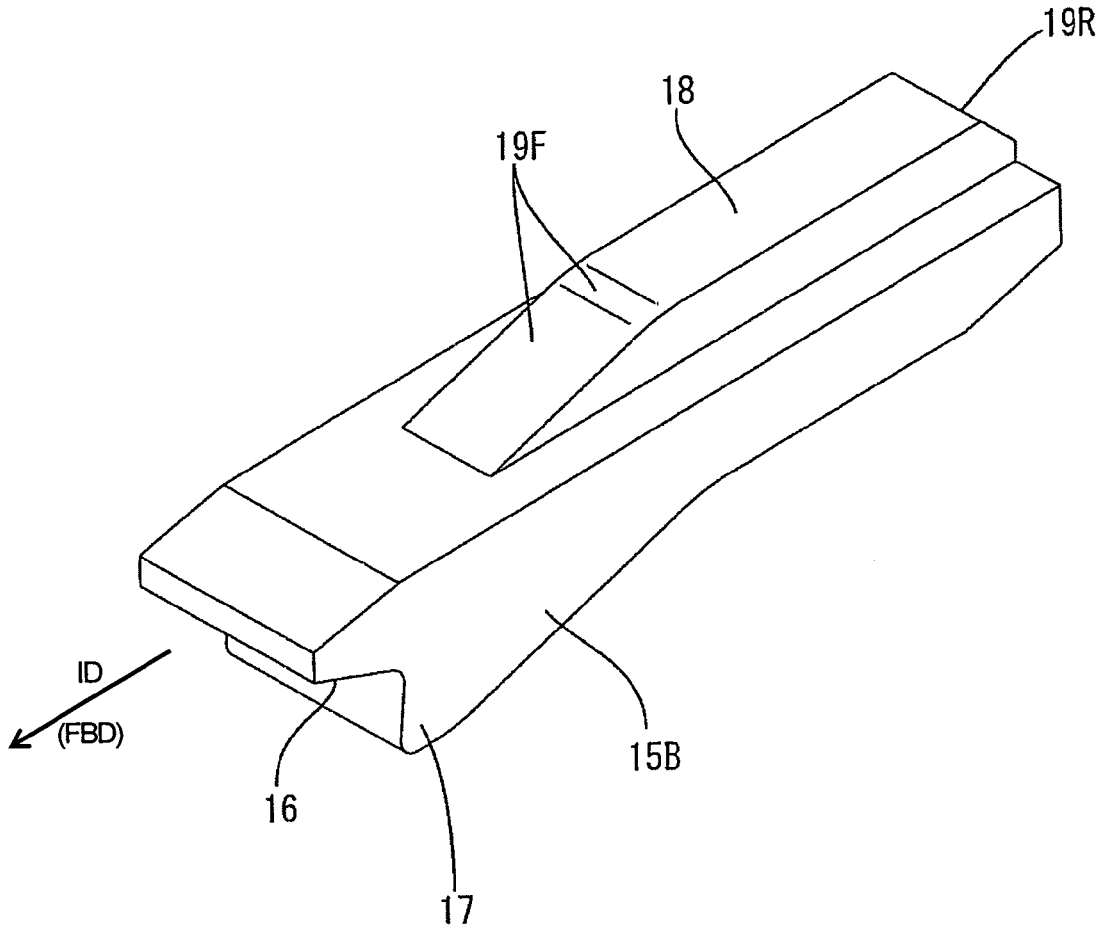
FIG. 5 is an enlarged perspective view of the locking portion at the lower stage when viewed from below.
Figure 6:
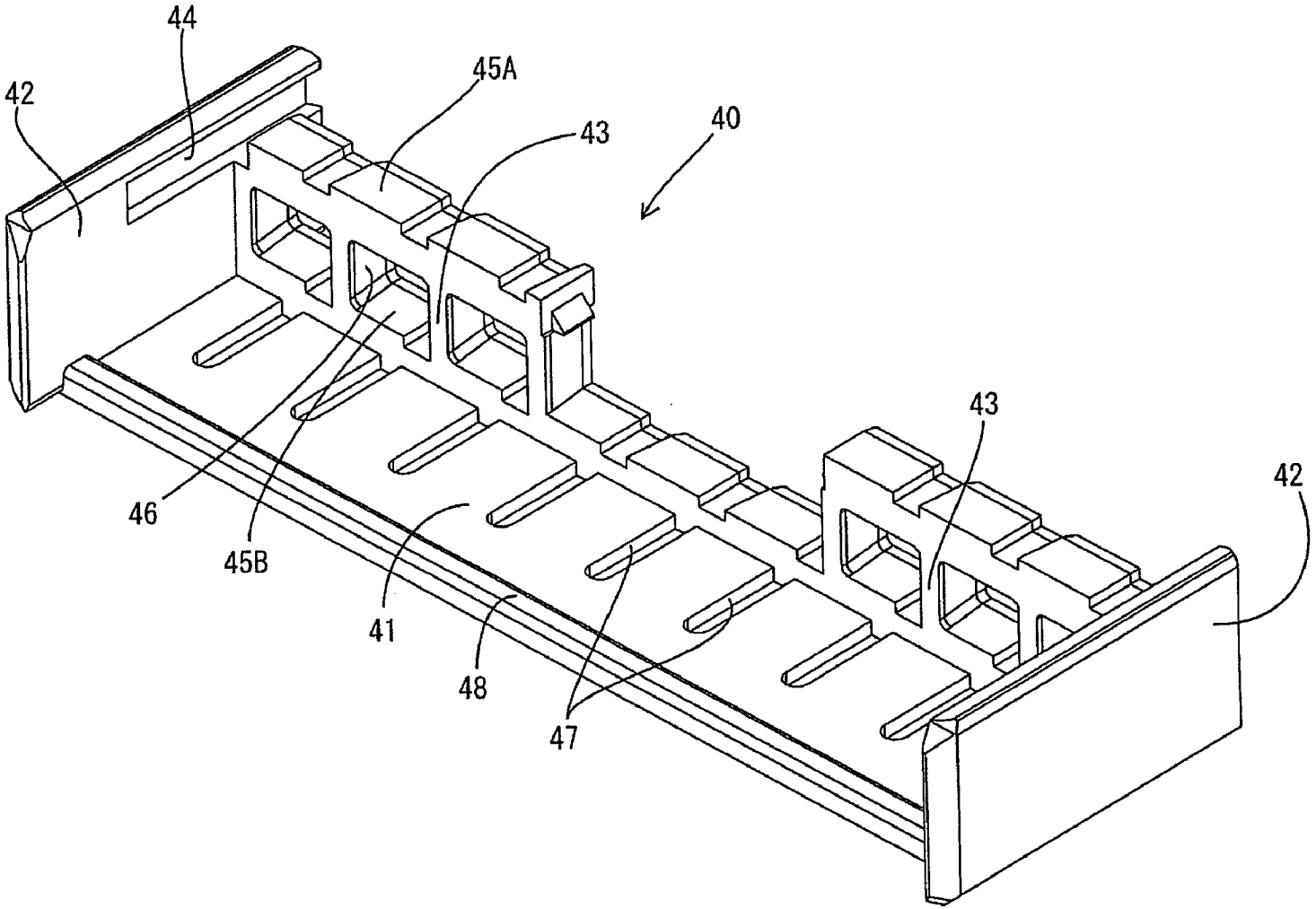
FIG. 6 is a perspective view of the protecting member.
Figure 7:
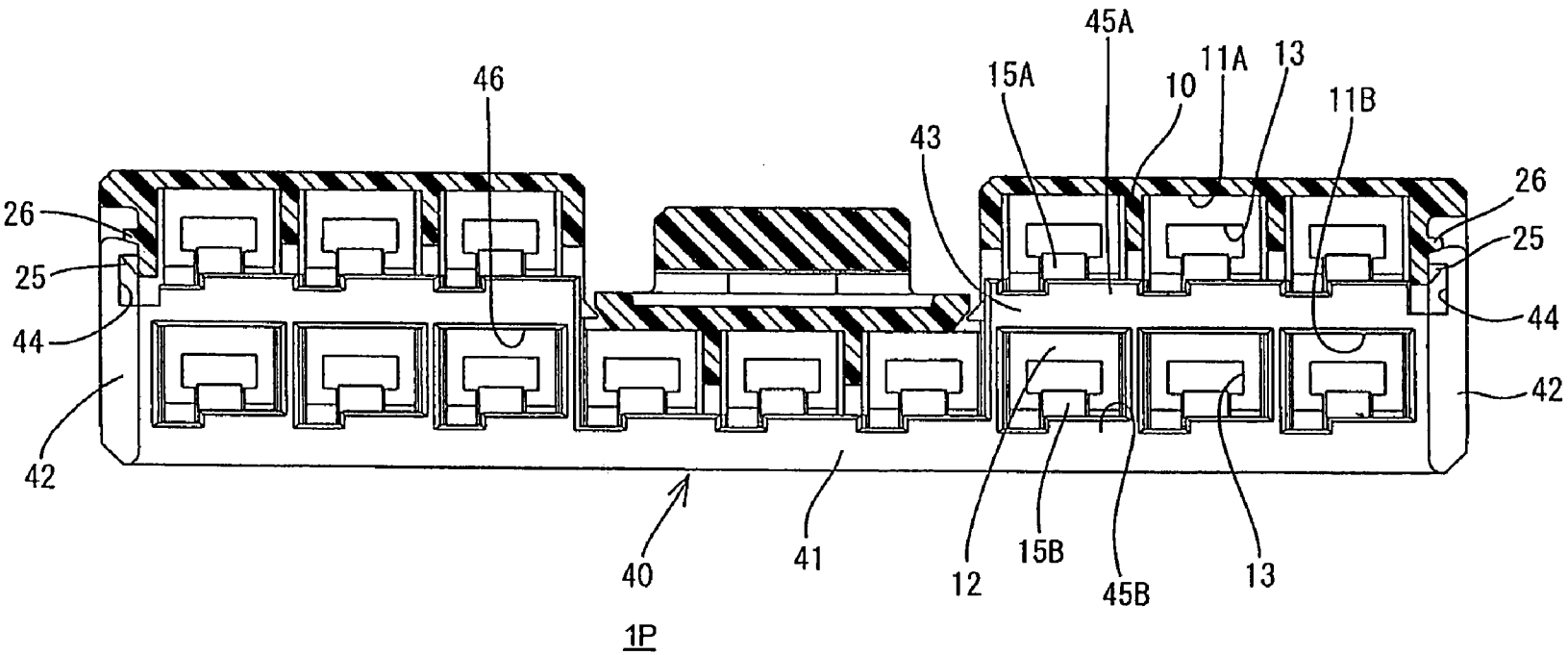
FIG. 7 is a lateral section showing a state where the protecting member is at the partial locking position.
Figure 8:
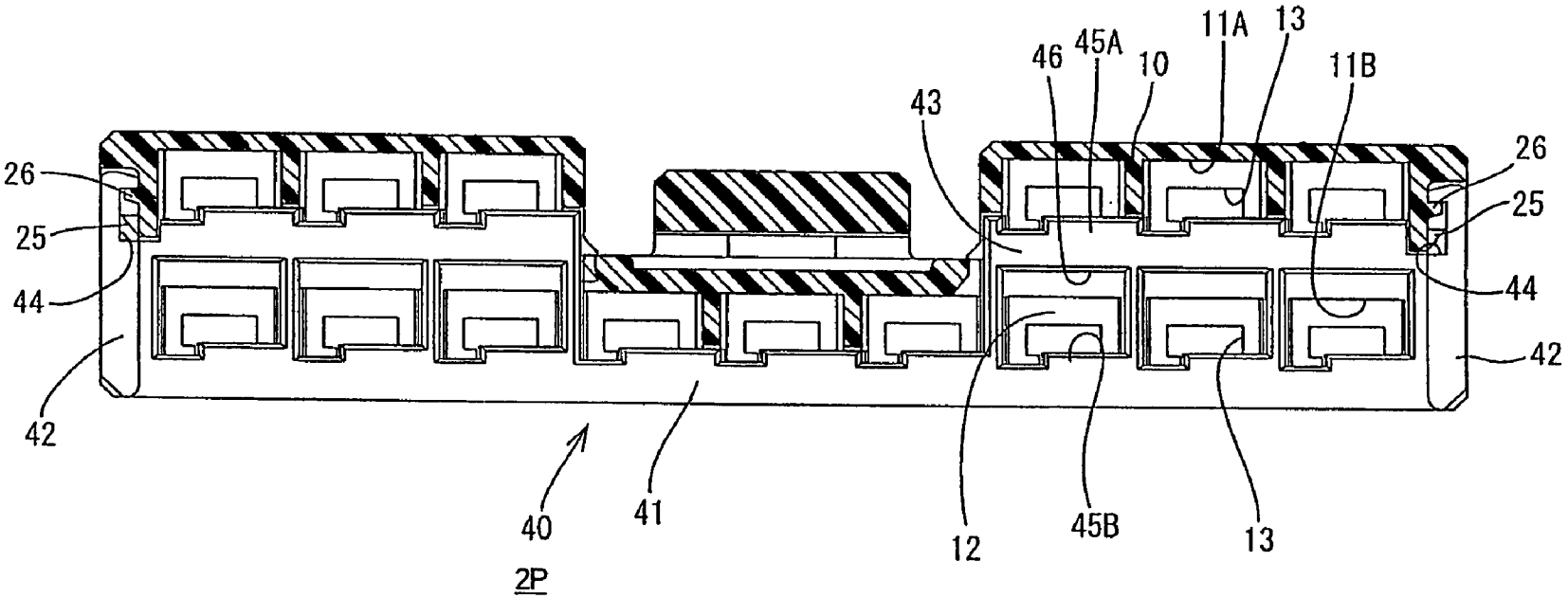
FIG. 8 is a lateral section showing a state where the protecting member is at the full locking position.
Figure 9:
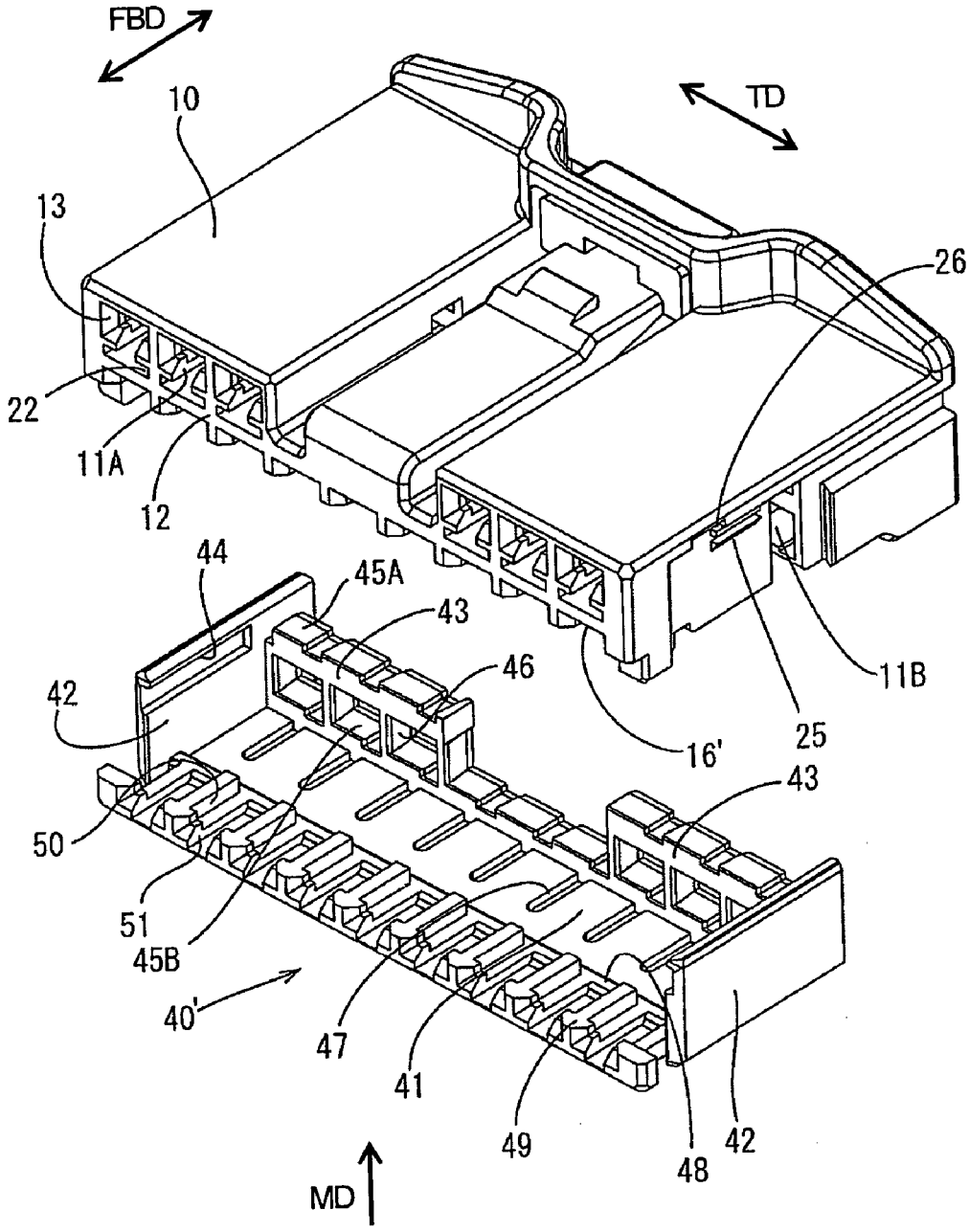
FIG. 9 is a perspective view of a housing and an opening forming member according to a second embodiment of the invention.
Figure 10:
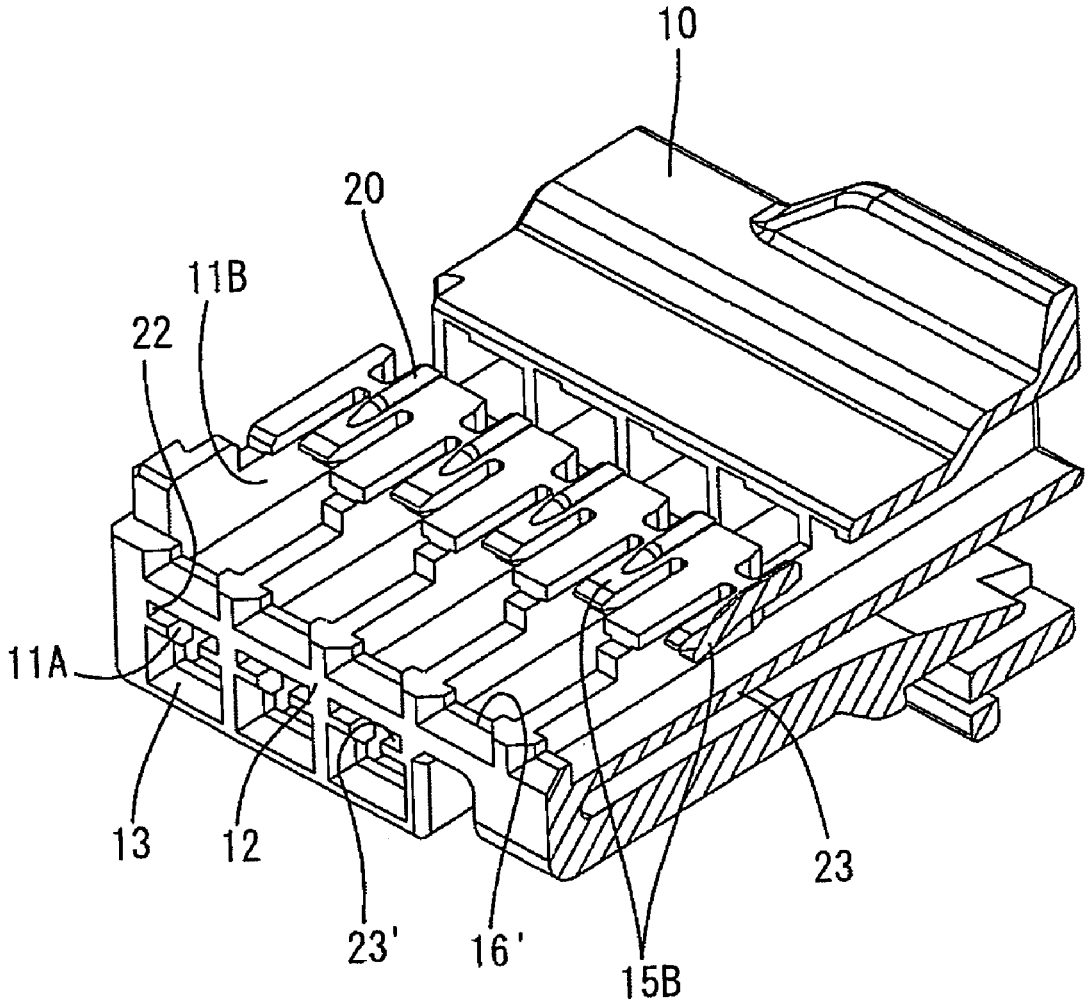
FIG. 10 is a perspective view partly in section showing the housing turned upside down.

A connector according to a first embodiment of the invention is illustrated in FIGS. 1 to 8. The connector has a housing 10 made e.g. of a synthetic resin. The housing 10 is substantially in the form of a flat block, and terminal cavities 11A, 11B are formed substantially side by side in the housing 10 at upper and lower stages. The terminal cavities 11A, 11B are narrow and long substantially along forward and backward directions (FBD), and the front ends of the terminal cavities 11A, 11B are substantially exposed at the front end surface of the housing 10 via tab insertion openings 13 penetrating a front wall 12 of the housing 10, whereas terminal insertion openings 14 are formed in the rear end surface of the housing 10. Locks 15A, 15B are formed on the bottom walls of the terminal cavities 11A, 11B and cantilever forward in an inserting direction ID of the terminal fitting 30 into the respective cavity 11A, 11B. In other embodiments the locks may define a bridge shape with supports at both ends and with an intermediate portion of the lock being deformable in a direction intersecting the inserting direction ID.

Each lock 15A, 15B is a substantially flat plate that has a substantially constant width and thickness over substantially the entire length. A jig receiving surface 16 is formed at the front end of the upper surface of each lock 15A, 15B and is recessed to slope down towards the front. A locking projection 17 is formed in an area of the upper surface of each lock 15A, 15B behind and adjacent to the jig receiving surface 16. The locks 15A, 15B are resiliently deformable up and down substantially normal to inserting and withdrawing directions ID of the terminal fittings 30 into and from the cavities 11A, 11B with the rear ends as supports. Upper surfaces of the locks 15A, 15B are substantially flush with and at the substantially same height as the bottom walls of the cavities 11A, 11B when the locks 15A, 15B are in their free states and not deformed. Thus, the locking projections 17 are located at least partly in the cavities 11A, 11B. However, the locks 15A, 15B can be deformed out and down so that the locking projections 17 retract from the insertion spaces for the terminal fittings 30.

A reinforcing rib 18 is formed substantially in the widthwise center of the lower surface of each lock 15B and is narrower than the lock 15B. The reinforcing rib 18 has a front end slightly behind the front end of the lock 15B and substantially aligned with the middle of the locking projection 17 with respect to the forward and backward direction FBD. The rear end of the reinforcing rib 18 is at the rear end of the lock 15B. A slanted surface 19F is formed at the front end of the reinforcing rib 18 and has at least two different inclinations. A slanted surface 19R is formed at the rear end of the reinforcing rib 18 and has a substantially constant inclination. A reinforcing rib 20 also is formed on the lower surface of each lock 15A at the upper stage.

Deformation spaces 21A, 21B are provided in the housing 10 for permitting the resilient deformation of the locks 15A, 15B. The deformation spaces 21A for the locks 15A at the upper stage are below the respective locks 15A and are open at the front end of the housing 10. The deformation spaces 21A at the upper stages and the terminal cavities 11A are vertically adjacent to each other. Bottom walls 22 are defined as partitions between the deformation spaces 21A at the upper stage and the terminal cavities 11B at the adjacent lower stage.

The deformation spaces 21B for the locks 15B at the lower stage are below the respective locks 15B and are open at the front end of the housing 10, similar to the deformation spaces 21A at the upper stages. Areas of the deformation spaces 21B at the lower stages corresponding to the locks 15B and areas slightly before the locks 15B open in the bottom outer surface of the housing 10. This opening 23 of the deformation spaces 21B is formed over substantially the entire width of the housing 10. The reinforcing rib 18 on the lower surface of each lock 15B is inside the deformation space 21B without projecting out from the bottom surface of the housing 10 when the lock 15B is in an undeformed state.

Each terminal fitting 30 is a female terminal fitting that is long and narrow along forward and backward directions FBD. A substantially rectangular tube 31 is formed at the front portion of the terminal fitting 30 and a wire connecting portion 32 is formed at a rear portion of the terminal fitting 30. The wire connecting portion 32 is a barrel that can be crimped, bent or folded into connection with an end of a wire 33. A locking hole or step (not shown) is formed in the bottom surface of the tube 31 and is engageable with the locking projection 17 of the lock 15A, 15B. The terminal fitting 30 is inserted in the inserting direction ID into the terminal cavity 11A, 11B from behind. In the insertion process, the bottom surface of the tube 31 contacts the locking projection 17 and deforms the lock 15A, 15B down in a direction intersecting the inserting direction ID. Thus, the lock 15A, 15B enters the deformation space 21A, 21B and assumes a forward-inclined posture (see FIG. 3). The lock 15A, 15B returns resiliently when the terminal fitting 30 reaches a substantially proper insertion position so that the locking projection 17 engages in the locking hole. Accordingly, the terminal fitting 30 is held to prevent its backward withdrawal.

A long narrow jig (not shown) can be inserted through a jig insertion opening 24 in the front surface of the housing 10 and can be operated while the leading end of the jig is held in contact with the jig receiving surface 16 of the locking portion 15A, 15B. Thus, the lock 15A, 15B can be deformed towards the deformation space 21A, 21B to disengage the locking projection 17 from the locking hole or step. In this way, the terminal fitting 30 can be freed from the lock 15A, 15B and the terminal fitting 30 can be withdrawn from the terminal cavity 11A, 11B.

The connector also includes a protector 40 made e.g. of a synthetic resin. The protector 40 has a rectangular plate-shaped wall 41 that is substantially parallel with the bottom surface of the housing 10. Side walls 42 project up from the opposite left and right edges of the wall 41, and a rear wall 43 projects up from the rear end of the wall 41. A locking groove 44 is formed in the inner surface of each side wall 42. A terminal locking portion 45A is formed at the upper end of the rear wall 43 and is engageable with the rear ends tubes 31 of the terminal fittings 30 inserted into the terminal cavities 11A at the upper stage. Further, the rear wall 43 has at least one through hole 46 penetrating in forward and backward directions FBD. A terminal locking portion 45B is formed at the lower edge of the through hole 46 and is engageable with the rear ends of the tubes 31 of the terminal fittings 30 inserted into the terminal cavities 11B at the lower stage. Accordingly, the protector 40 is a retainer for doubly locking the terminal fittings 30 in the respective cavities 11.

The protector 40 is mounted to the housing 10 from below, while the opposite side walls 42 are aligned with the outer side surfaces of the housing 10. The protector 40 can be held either at a partial locking position 1P or a full locking position 2P. The locking grooves 44 engage partial locking projections 25 of the housing 10 when the protector 40 is at the partial locking position 1P (see FIG. 7). On the other hand, the locking grooves 44 engage the full locking projections 26 of the housing 10 when the protector 40 is moved up to the full locking position 2P (see FIG. 8).

The wall 41 has a shape substantially corresponding to the opening 23 of the deformation spaces 21B at the lower stage in the bottom surface of the housing 10, and hence the wall 41 can substantially close the opening 23. The wall 41 projects down from the bottom surface of the housing 10 when the protector 40 is at the partial locking position 1P. A space is provided between the upper of the wall 41 and the lower surfaces of the locks 15B in their free unbiased states (see FIGS. 2 and 3). The space enables the locks 15B to be deformed towards the deformation spaces 21 B sufficiently to permit insertion of the terminal fittings 30. When the protector 40 is at the full locking position 2P, the lower surface of the wall 41 is substantially flush with the bottom surface of the housing 10 and the upper surface of the wall 41 substantially contacts the lower surfaces of the front ends of the undeformed locks 15B (see FIG. 1). Thus, the locks 15B cannot deform towards the deformation spaces 21B and the locking projections 17 cannot disengage from the terminal fittings 30 when the protector 40 is at the full locking position 2P.

The wall 41 has transversely spaced escaping portions 47 that correspond to the lower stage locks 15B. The escaping portions 47 are disposed and dimensioned to receive the reinforcing ribs 18 and penetrate the wall 41 in a direction of deformation of the locks 15. The escaping portions 47 are outward of the reinforcing ribs 18 of the locks 15B in their free states when the protector 40 is at the partial locking position 1P. However, the reinforcing ribs 18 are in the escaping portions 47 when the protector 40 is at the full locking position 2P. A transversely-extending reinforcing rib 48 projects up at the front of the wall 41 and before the locks 15B.

The terminal fittings 30 are inserted into the cavities 11A, 11B along the inserting direction ID while the protector 40 is at the partial locking position 1P. In this state, the wall 41 is spaced vertically from the locks 15B at the lower stage. Thus, the locks 15B can deform towards the deformation spaces 21B and the terminal locking portions 45A, 45B are retracted from the cavities 11A, 11B. Accordingly, the locks 15A, 15B do not hinder insertion of the terminal fittings 30 into the cavities 11A, 11B.

The locks 15A, 15B resiliently return towards their free states and the locking projections 17 engage the locking holes or step to retain the terminal fittings 30 that have been inserted to substantially proper positions. Thereafter, the protector 40 is pushed up from the partial locking position 1P to the full locking position 2P. The terminal locking portions 45A, 45B then engage the tubes 31 to retain the terminal fittings 30. In other words, the terminal fittings 30 are locked doubly by the locks 15A, 15B and the protector 40. When the protector 40 is displaced to the full locking position 2P, the wall 41 enters the deformation space for the locks 15B and substantially contacts or approaches the lower surfaces of the locks 15B. Thus, the reinforcing ribs 18 enter the escaping portions 47. In this state, the wall 41 prevents resilient deformations of the locks 15B for the terminal fittings 30 inserted into the lower stage terminal cavities 11B, and the terminal fittings 30 are locked triply by the lock 15B, the terminal locking portion 45B and the wall 41.

The terminal fittings 30 can be withdrawn from the cavities 11A, 11B by displacing the protector 40 to the partial locking position 1P. As a result, the terminal locking portions 45A, 45B disengage from the terminal fittings 30. Further, the wall 41 is moved into a position where the lower stage locks 15B can deform towards the deformation spaces 21B. The jig (not shown) then is inserted though the jig insertion opening 24 from the front side of the housing 10. The jig contacts the jig receiving surface 16 of the respective lock 15A, 15B and is operated to deform the lock 15A, 15B towards the deformation space 21A, 21B and away from the terminal fitting 30. The terminal fitting 30 then may be pulled back pulling the wire or by operating the terminal fitting 30 in another way.

As described above, the reinforcing ribs 18, 20 project from the surfaces of the locks 15A, 15B that face the deformation spaces 21A, 21B. The reinforcing ribs 18, 20 increase the rigidity of the locks 15A, 15B. Therefore, the terminal fittings 30 are retained more reliably is higher.

The escaping portions 47 are formed in the surface of the wall 41 facing the locks 15B at the lower stage. The reinforcing ribs 18 are accommodated in the escaping portions 47 when the protector 40 is at the full locking position 2P. Thus the reinforcing ribs 18 do not enlarge the connector along the deforming direction of the locks 15B.

The deformation spaces 21B at the lower stage have the opening 23 in the outer surface of the housing 10. The protector 40, including the wall 41 facing the deformation spaces 21B and the escaping portions 47, is mounted into the opening 23. In other words, the wall 41 facing the deformation spaces 21B is separate from the housing 10 while the deformation spaces 21B make the opening in the outer surface of the housing 10. Thus, the housing 10 is smaller along the deforming direction of the locks 15B.

The wall 41 enters the deformation areas for the locks 15B when the protector 40 is at the full locking position 2P. Thus, the housing 10 is smaller along the deforming direction of the locks 15B as compared to a case where the spaces for the deformation of the locks remain. Further, the opening 23 of the deformation spaces 21B in the outer surface of the housing 10 is closed by the wall 41 of the protector 40. Thus, external matter cannot enter the housing 10 through the opening 23.

The wall 41 contacts the locks 15B to prevent deformations of the locks 15B towards the deformation spaces 21B when the protector 40 is at the full locking position 2P. Thus, the terminal fittings 30 are held more reliably.

The terminal locking portions 45A, 45B of the protector 40 engage the terminal fittings 30 in the cavities 11A, 11B when the protector 40 is at the full locking position 2P. Thus, the terminal fittings 30 are retained more reliably.

The escaping portions 47 penetrate the wall 41. Thus, the connector can be made smaller along the deforming direction of the locks 15B as compared to a case where the escaping portions are bottomed recesses.

A second embodiment is described with reference to FIGS. 9 to 19. It should be understood that features similar or substantially same as in the previous embodiment are marked with the same reference numeral. The connector of this embodiment has a housing 10 e.g. made of a synthetic resin. The housing 10 is a substantially flat block with an upper stage of side by side cavities 11A and a lower stage of side by side cavities 11B. The cavities 11A at the upper stage are narrow and long along forward and backward directions FBD. The housing 10 has a front wall 12 and tab insertion openings 13 extend through the front wall 12 and into the cavities 11A. Terminal insertion openings 14 extend into the cavities 11A at the rear end of the housing 10. Locks 15A are cantilevered from the bottom walls of the cavities 11A and extend substantially forward in an inserting direction ID of the terminal fitting 30 into the respective cavity 11.

The cavities 11B at the lower stage also are narrow and long along forward and backward directions FBD. Recesses 16' extend into the bottom part of the front wall 12 of the housing 10 and into the cavities 11B. The recesses 16 form tab insertion openings 17'. Terminal insertion openings 14 extend into the terminal cavities 11B at the rear end of the housing 10. Locks 15B cantilever forwardly from the bottom wall of each cavity 11B. In other embodiments, the locks can be substantially bridge-shaped with supports at opposite ends and an intermediate portion that is deformable in a direction intersecting the inserting direction ID.

The locks 15A, 15B are substantially flat plates with thicknesses and widths that are substantially constant over substantially the entire length. A downwardly inclined jig receiving surface 18' is formed at the front end of the upper surface of each lock 15A, 15B. Further, a locking projection 19 is formed in an area of the upper surface of each lock 15A, 15B behind and adjacent to the jig receiving surface 18. The locks 15A, 15B are resiliently deformable up and down substantially normal to inserting and withdrawing directions ID of the terminal fittings 30 into and from the cavities 11A, 11B with the rear ends as supports. Upper surfaces of the locks 15A, 15B are substantially flush with and at the same height as the bottom walls of the cavities 11A, 11B when the locks 15A, 15B are not deformed. Thus, the locking projections 19 are in the cavities 11A, 11B when the locks 15A, 15B are unbiased. However, the locks 15A, 15B can be deformed resiliently down towards deformation spaces 21A, 21B and in a direction intersecting the inserting direction ID so that the locking projections 19 are retracted down from the insertion spaces for the terminal fittings 30. A reinforcing rib 20 is formed on the lower surface of each lower stage lock 15B. The reinforcing rib 20 is in the widthwise center and extends from a position aligned substantially with the longitudinal middle of the locking projection 19 to the rear end of the lock 15B. The reinforcing rib 20 is narrower than the lock 15B.

Deformation spaces 21A, 21B are provided in the housing 10 for permitting deformation of the locks 15A, 15B. The deformation spaces 21A for the locks 15A at the upper stage are below of the respective locks 15A and extend forward to define jig insertion openings 22 at the front end of the housing 10. The jig insertion openings 22 are wide slits and communicate with the tab insertion openings 13. The deformation spaces 21A at the upper stages and the terminal cavities 11A are vertically adjacent to each other with the locks 15A therebetween. Bottom walls 23' are at the bottoms of the deformation spaces 21A of the upper stage and define partitions between the deformation spaces 21A and the terminal cavities 11B at the lower stage.

The deformation spaces 21B for the locks 15B at the lower stage are below the respective locks 15B and make openings at the front end of the housing 10 similar to those at the upper stage. Opening areas of the deformation spaces 21B in the front of the housing 10 communicate with the tab insertion openings 17. The deformation spaces 21B at the lower stage also opening at the bottom outer surface of the housing 10. This bottom opening extends in an area from the rear ends of the locks 15B substantially to the front of the housing 10 and over substantially the entire width of the housing 10. The opening at the bottom of the deformation spaces 21B communicates with the opening areas of the deformation spaces 21B in the front of the housing 10.

The terminal fitting 30 can be removed from the terminal cavity 11A, 11B by inserting a long narrow jig J through a jig insertion opening 22, 52 in the front surface of the housing 10 and into contact with the jig receiving surface 18 of the lock 15A, 15B. The jig J then is manipulated to deform the lock 15A, 15B out towards the deformation space 21A, 21B and to disengage the locking projection 19 from the terminal fitting 30.

The connector further includes an opening forming member 40' made e.g. of a synthetic resin. The opening forming member 40' includes a rectangular plate-shaped wall 41 aligned substantially parallel with the bottom surface of the housing 10. Side walls 42 project from the opposite left and right edges of the wall 41, and a rear wall 43 projects from the rear end of the wall 41. A locking groove 44 is formed in the inner surface of each side wall 42. A terminal locking portion 45A is defined at the upper end of the rear wall 43 and engages the rear ends of the tubes 31 of the terminal fittings 30 in the upper stage cavities 11A. Through holes 46 penetrate the rear wall 43 in forward and backward directions FBD, and terminal locking portions 45B are defined at lower edges of the through holes 46 for engaging the rear ends of the tubes 31 of the terminal fittings 30 in the lower stage cavities 11B.

The opening forming member 40' is mounted from below and along a mounting direction MD into the housing 10 while the opposite side walls 42 align with the outer side surfaces of the housing 10. The opening forming member 40' can be held either at a partial locking position 1P or a full locking position 2P. The locking grooves 44 engage partial locking projections 25 of the housing 10 when the opening forming member 40' is at the partial locking position 1P (see FIG. 17). However, the locking grooves 44 engage full locking projections 26 of the housing 10 when the opening forming member 40' is pushed up to the full locking position 2P (see FIG. 18).

The wall 41 has a shape substantially corresponding to the opening in the bottom surface of the housing 10 adjacent the lower stage deformation spaces 21B. The wall 41 projects down from the bottom surface of the housing 10 when the opening forming member 40' is at the partial locking position 1P. Hence, space exists between the upper surface of the wall 41 and the lower surfaces of the unbiased locks 15B. Accordingly, the locks 15B can be deformed resiliently into the deformation spaces 21B sufficiently to permit the insertion of the terminal fittings 30. The lower surface of the wall 41 is substantially flush with the bottom surface of the housing 10 when the opening forming member 40' is at the full locking position 2P. Additionally, the upper surface of the wall 41 contacts or is close to the lower surfaces of the front ends of the locks 15B in their free states. Thus, the locks 15B cannot deform towards the deformation spaces 21B and the locking projections 19 cannot disengage from the terminal fittings 30.

Transversely spaced escaping slots 47 vertically penetrate the wall 41 at positions substantially corresponding to the locks 15B at the lower stage. The escaping slots 47 are arranged to correspond to the reinforcing ribs 20 and have lengths and widths to receive the reinforcing ribs 20. The escaping slots 47 are below the reinforcing ribs 20 when the locks 15B are in their undeflected states and when the opening forming member 40' is at the partial locking position 1P. However, the reinforcing ribs 20 enter the escaping slots 47 when the opening forming member 40 is at the full locking position 2P. A reinforcing rib 48 extends in a transverse direction TD and projects up at a position on the wall 41 located before the locks 15B and before the escaping slots 47.

An opening forming portion 49 projects up substantially along the front end of the wall 41. Wide notches 50 are formed in upper part of the opening forming portion 49, and narrower notches 51 continue down from the respective wide notches 50. Each tab insertion opening 17 has a wide rectangular shape formed by the wide notch 50 and the corresponding recess 16 of the housing 10. The narrow notches 51 communicate with the bottom ends of the tab insertion openings 17 and also with the front ends of the lower stage deformation spaces 21B. Each jig insertion opening 52 is formed by the tab insertion opening 17 and the corresponding narrow notch 51. Thus, the jig J is insertable into the narrow notches 51.

Figure 11:
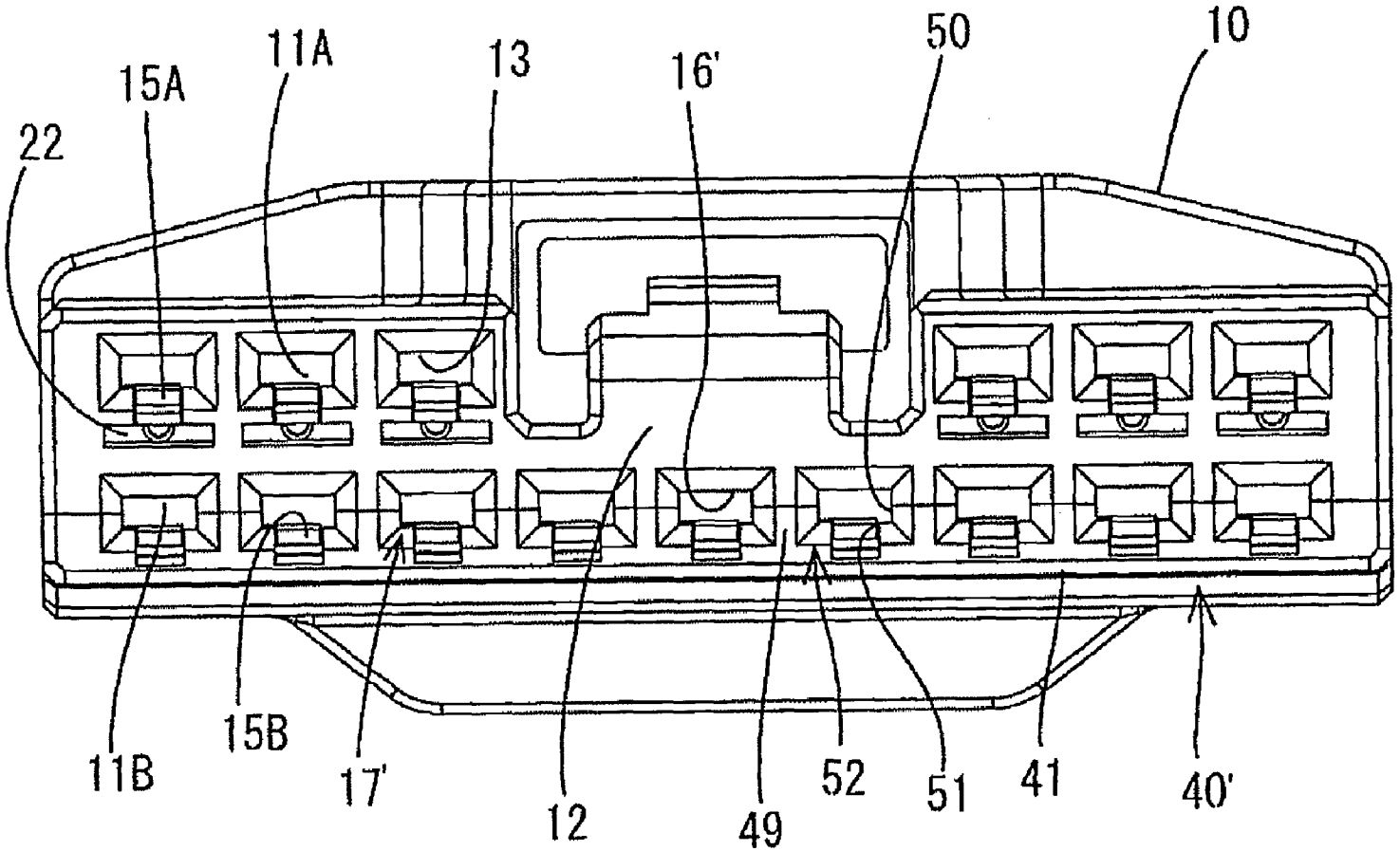
FIG. 11 is a front view showing a state where jig insertion openings are narrowed.
Figure 12:
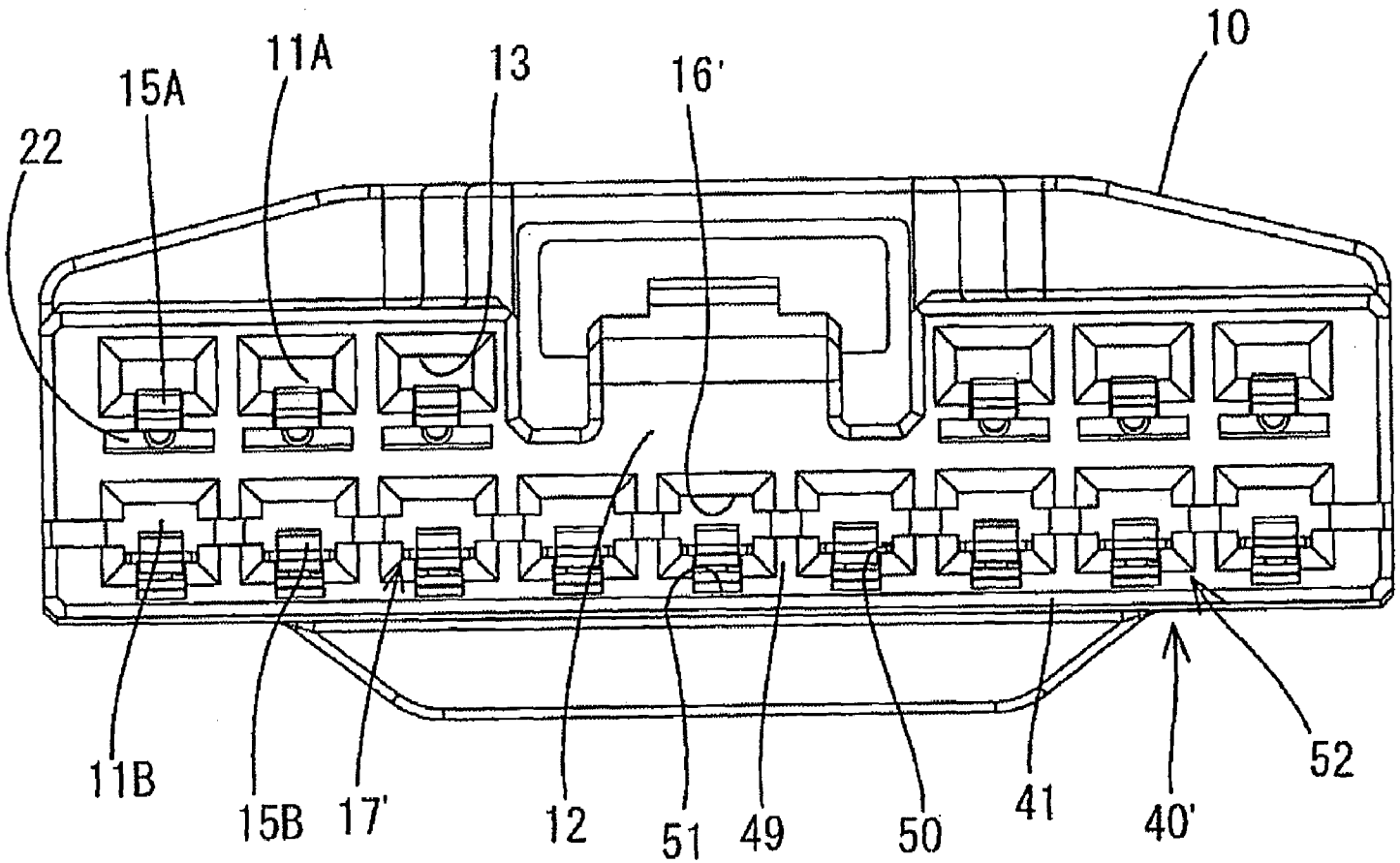
FIG. 12 is a front view showing a state where the jig insertion openings are widened.
Figure 13:
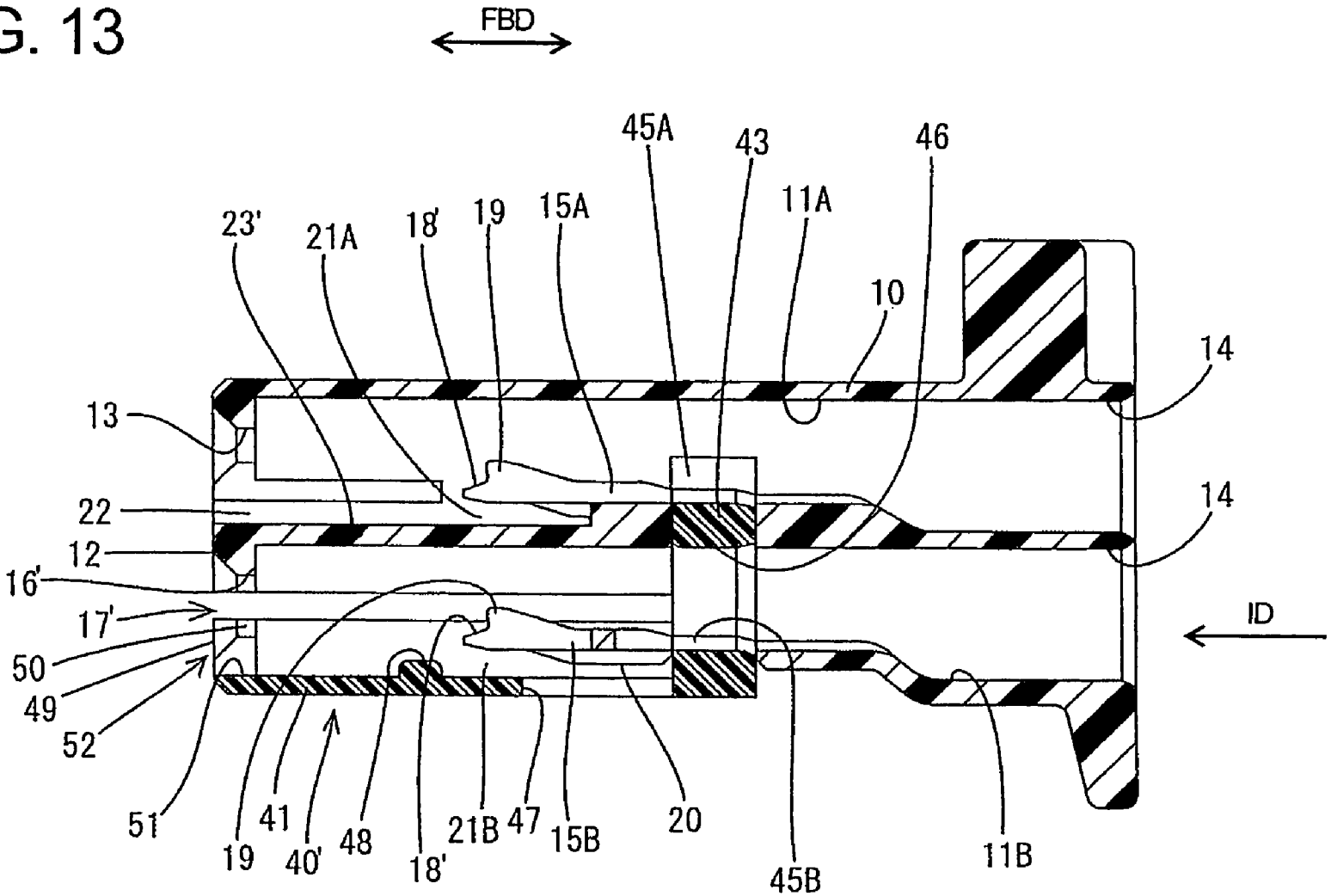
FIG. 13 is a longitudinal section showing a state where the opening forming member is at a partial locking position to widen the jig insertion openings.
Figure 14:
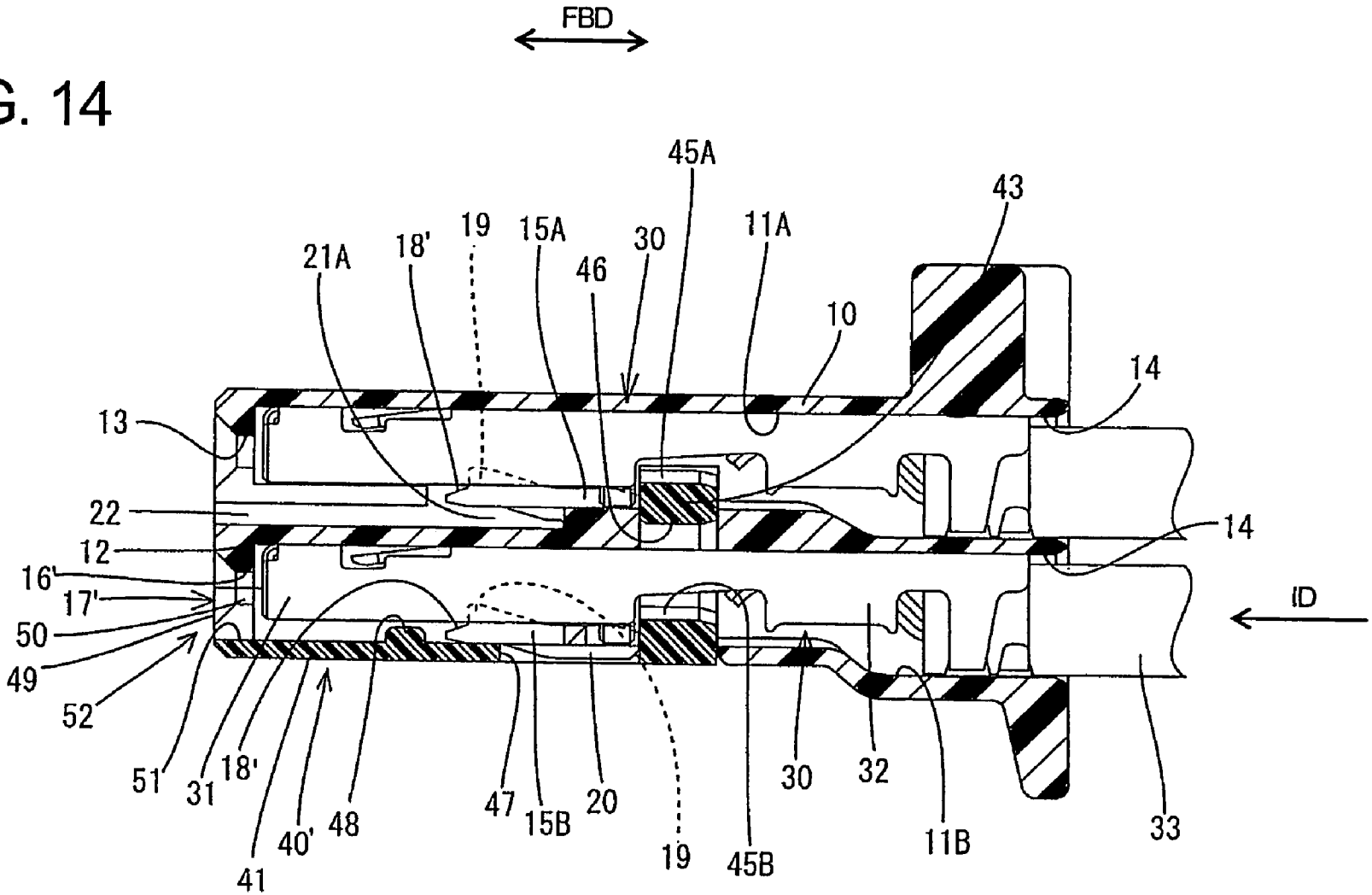
FIG. 14 is a longitudinal section showing a state where the opening forming member is at a full locking position to narrow the jig insertion openings.

The opening forming portion 49 of the opening forming member 40' is spaced down from the front wall 12 of the housing 10 when the opening forming member 40 is at the partial locking position 1P. Thus, the tab insertion openings 17 and the jig insertion openings 52 are widened vertically by vertically separating the recesses 16 and the wide notches 50, as shown in FIGS. 12 and 13. The upper surface of the opening forming portion 49 substantially contacts the bottom of the front wall 12 of the housing 10 when the opening forming member 40 is at the full locking position 2P. Thus, the tab insertion openings 17 and the jig insertion openings 52 are vertically narrowed, as shown in FIGS. 11 and 14, by bringing the recesses 16 and the wide notches 50 closer as compared to the state at the partial locking position 1P.

The opening forming member 40' initially is held at the partial locking position 1P. Thus, the wall 41 is spaced vertically from the lower stage locks 15B, and the lower stage locks 15B can deform resiliently into the deformation spaces 21B. Additionally, the terminal locking portions 45A, 45B are retracted down from the terminal cavities 11A, 11B and from the insertion paths for the terminal fittings 30. Thus, the terminal fittings 30 can be inserted into the terminal cavities 11A, 11B. The locks 15A, 15B deform resiliently into the deformation spaces 21A, 21B in the insertion process and do not hinder insertion of the terminal fittings 30.

The locks 15A, 15B resiliently return towards their free states when the terminal fittings 30 are inserted to proper positions. Thus, the locking projections 19 engage the locking holes, recesses or steps (not shown) of the rectangular tubes 31 to lock the terminal fittings 30. The opening forming member 40' then is pushed in the mounting direction MD from the partial locking position 1P to the full locking position 2P. As a result, the terminal locking portions 45A, 45B engage the substantially rectangular tubes 31 to retain the terminal fittings 30. In other words, the terminal fittings 30 are locked doubly by the locks 15A, 15B and the opening forming member 40'. Furthermore, the wall 41 substantially contacts the lower surfaces of the locks 15B and the reinforcing ribs 20 enter the escaping slots 47 when the opening forming member 40' is displaced to the full locking position 2P. In this state, since the wall 41 prevents the resilient deformations of the locks 15B for the terminal fittings 30 at the lower stage. Thus, the terminal fittings 30 are locked triply locked by the locks 15B, the terminal locking portion 45B and the wall 41.

A clearance between the upper surface of the reinforcing rib 48 and the bottom surfaces of the substantially rectangular tubes 31 of the terminal fittings 30 is narrower than the thickness of the jig J when the opening forming member 40' is at the full locking position 2P. Thus, even if the jig J is inserted inadvertently through the jig insertion opening 52 when the opening forming member 40' is at the full locking position 2P, the jig J merely contacts the reinforcing rib 48 before reaching the lock 15B. Accordingly, the jig J cannot resiliently deform the locks 15B in the unlocking direction while the opening forming member 40' is at the full locking position 2P.

The terminal fitting 30 can be withdrawn from the cavity 11A, 11B by displacing the opening forming member 40' in a direction opposite to the mounting direction MD to the partial locking position 1P. Thus, the terminal locking portions 45A, 45B disengage from the terminal fittings 30. Further, the wall is in a position that permits deformation of the lower stage locks 15B into the deformation spaces 21B. Further, the tab insertion openings 17 at the lower stage are divided for vertically widening the opening areas of the jig insertion openings 52 and/or for vertically widening the clearance between the bottom surfaces of the rectangular tubes 31 of the terminal fittings 30 and the upper surface of the wall 41.

The jig J then is inserted into the jig insertion opening 22, 52 and the clearance between the tube 31 and the wall portion 41. At this time, the jig J can be inserted easily at the lower stage since the vertical dimension between the upper edges of the recesses 16 and the bottom edges of the narrow notches 51 of the jig insertion openings 52 are enlarged.

The leading end of the jig J contacts the jig receiving surface 18 of the lock 15A, 15B. The jig J then is pivoted to bring its leading end down to deform the lock 15A, 15B into the deformation space 21A, 21B and away from the terminal fitting 30. The jig J can be inclined a large amount because the clearance between the rectangular tube 31 and the wall 41 also is enlarged vertically. The terminal fitting 30 therefore is freed from the deformed lock 15A, 15B and the wire 33 may be pulled back.

As described above, the jig J is inserted through the jig insertion opening 22, 52 in the front of the housing 10 and deforms the lock 15A, 15B away from the terminal fitting 30. The edges of the jig insertion openings 52 at the lower stage are formed by the opening forming member 40', which is separate from the housing 10 and displaceable relative to the housing 10 to widen the jig insertion openings 52.

Figure 15:
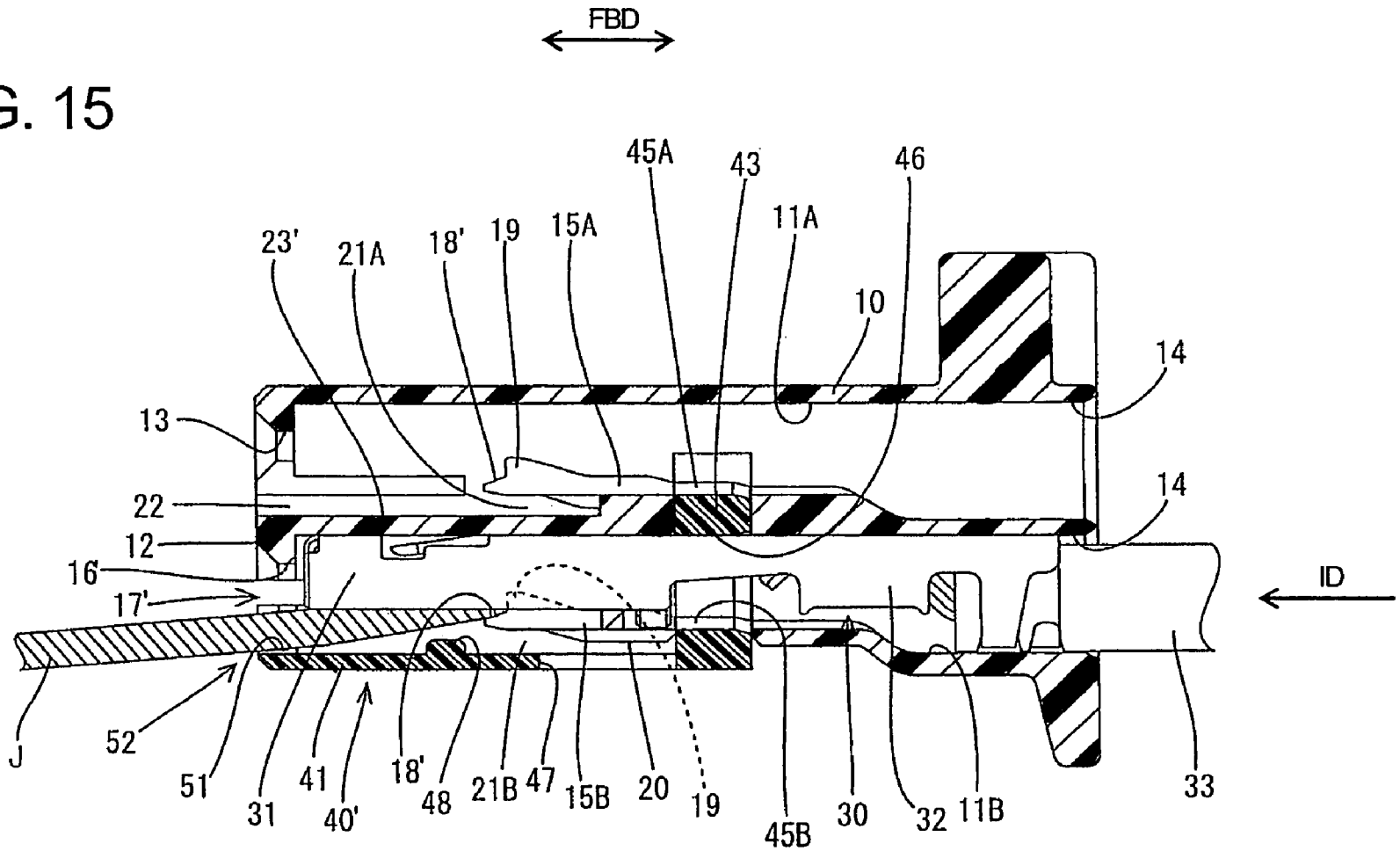
FIG. 15 is a longitudinal section showing a state where a jig is inserted with the jig insertion openings widened.
Figure 16:
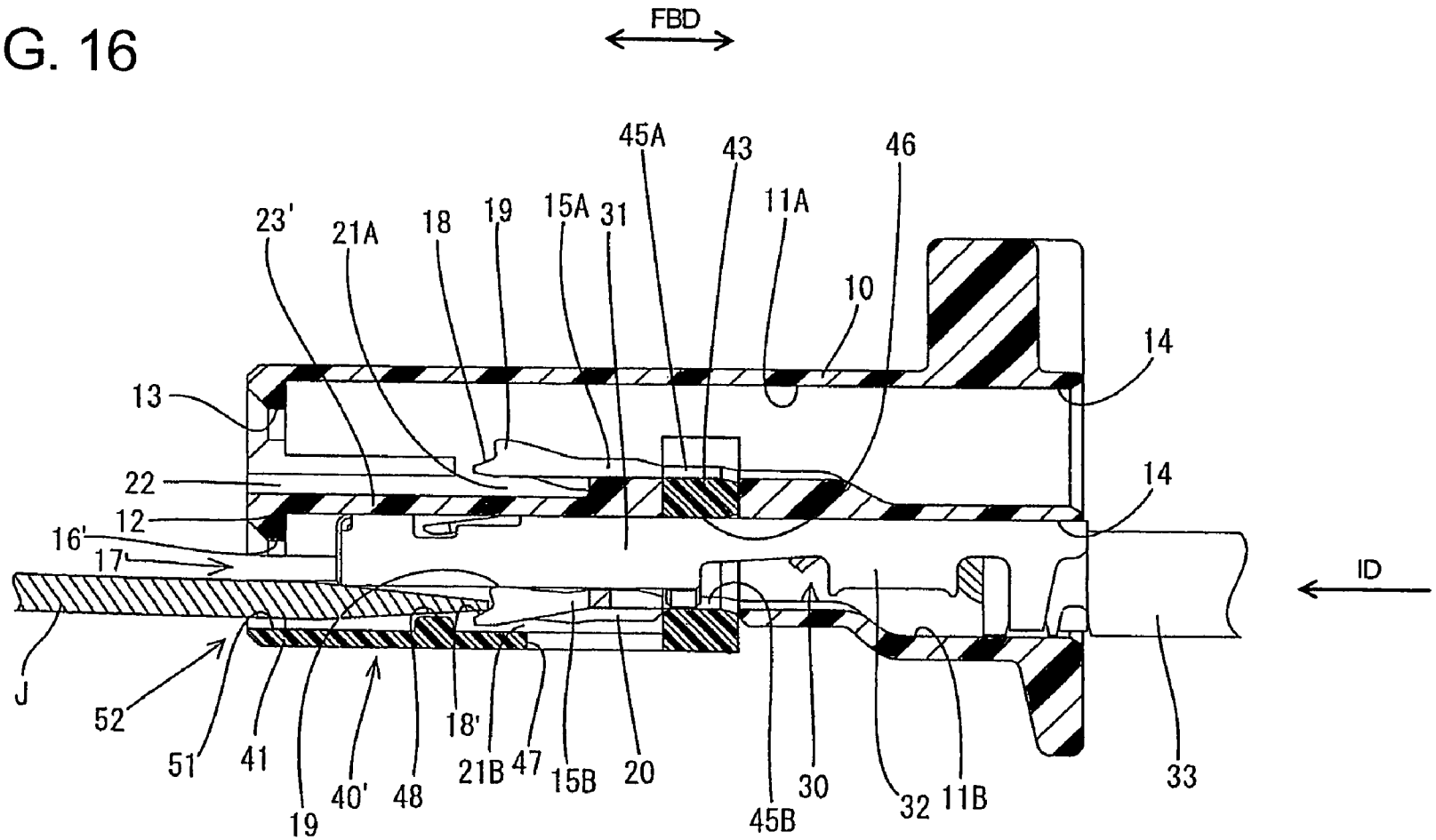
FIG. 16 is a longitudinal section showing a state where a locking portion is resiliently deformed in such a direction as to be disengaged from a terminal fitting by the jig inserted into the jig insertion opening.
Figure 17:
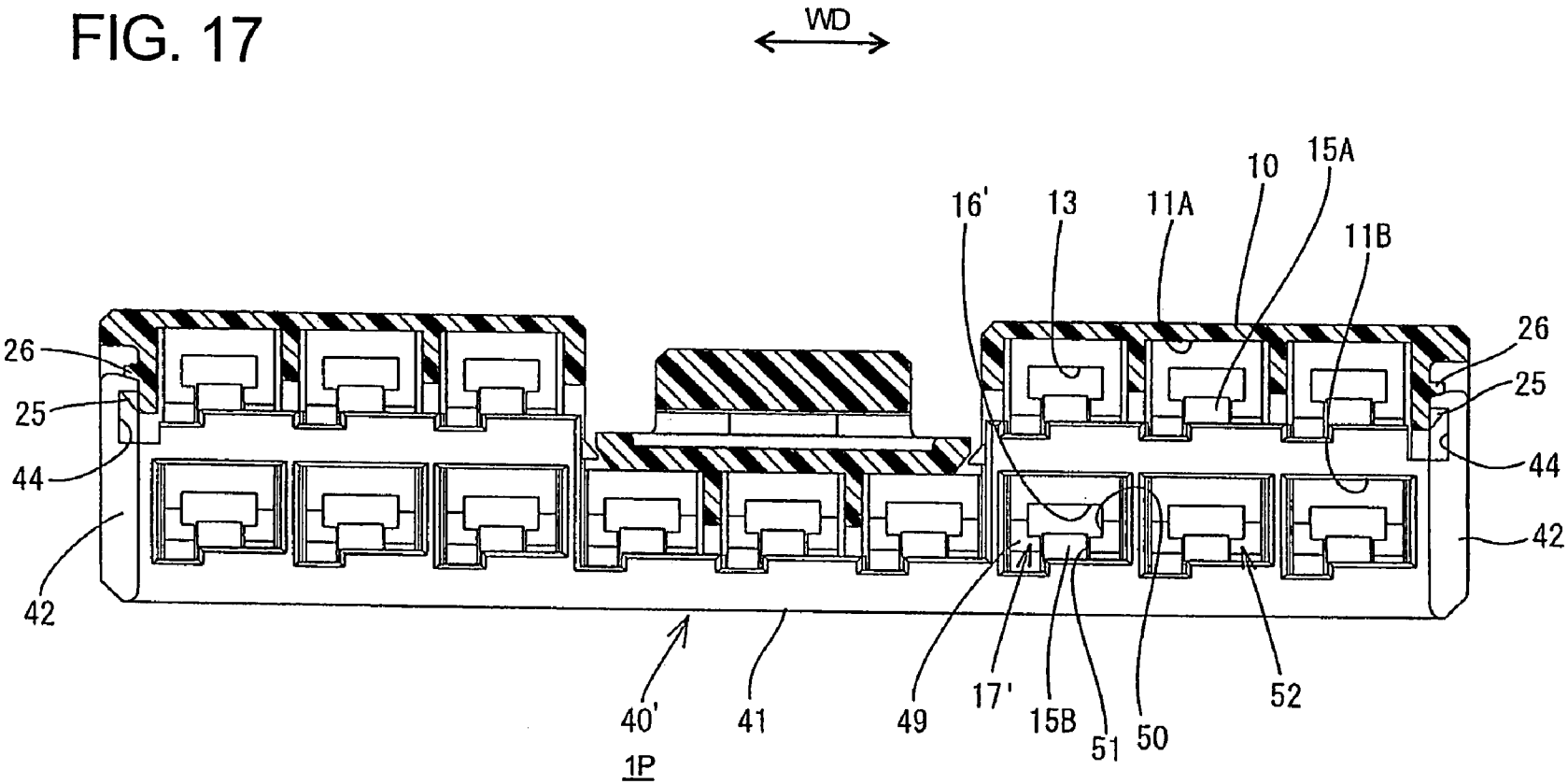
FIG. 17 is a lateral section showing a state where the opening forming member is at the full locking position.
Figure 18:
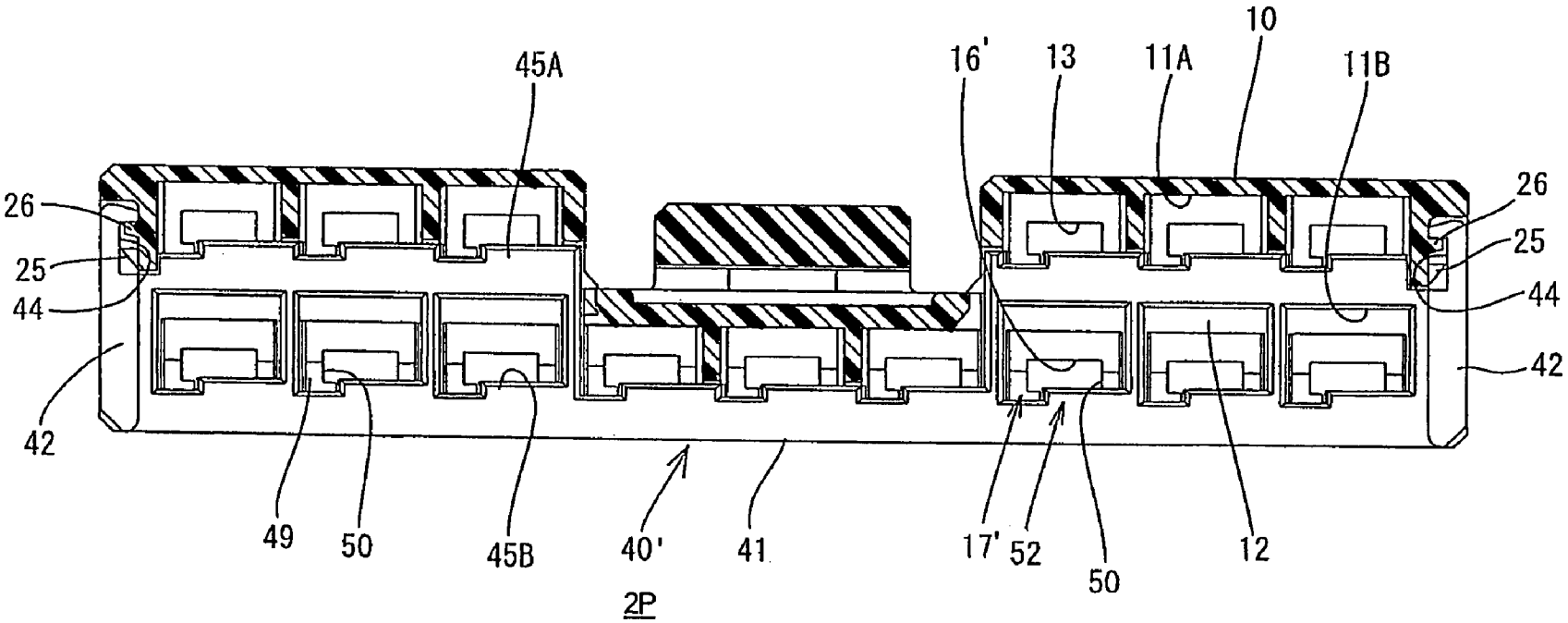
FIG. 18 is a lateral section showing a state where the opening forming member is at the full locking position.
Figure 19:
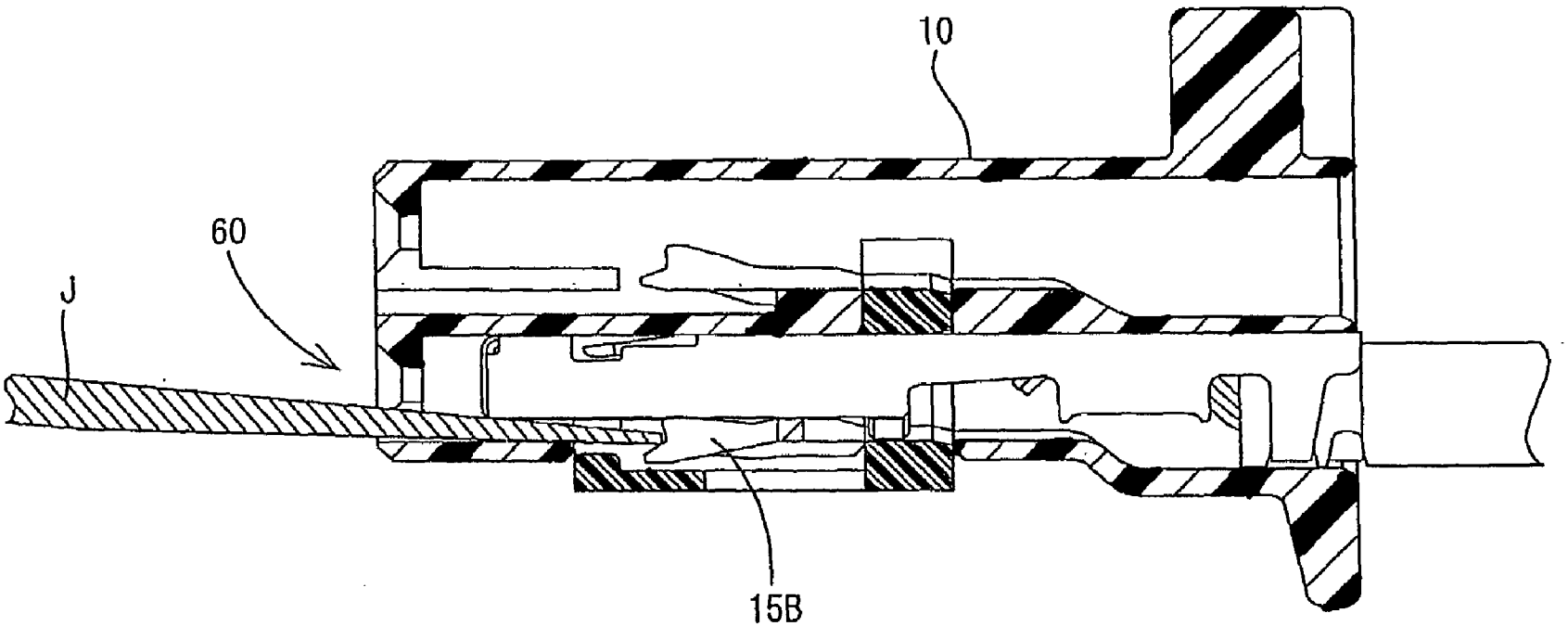
FIG. 19 PRIOR ART
FIG. 19 is a longitudinal section showing a state where a locking portion is resiliently deformed by a jig in a prior art connector.
Figure 20:
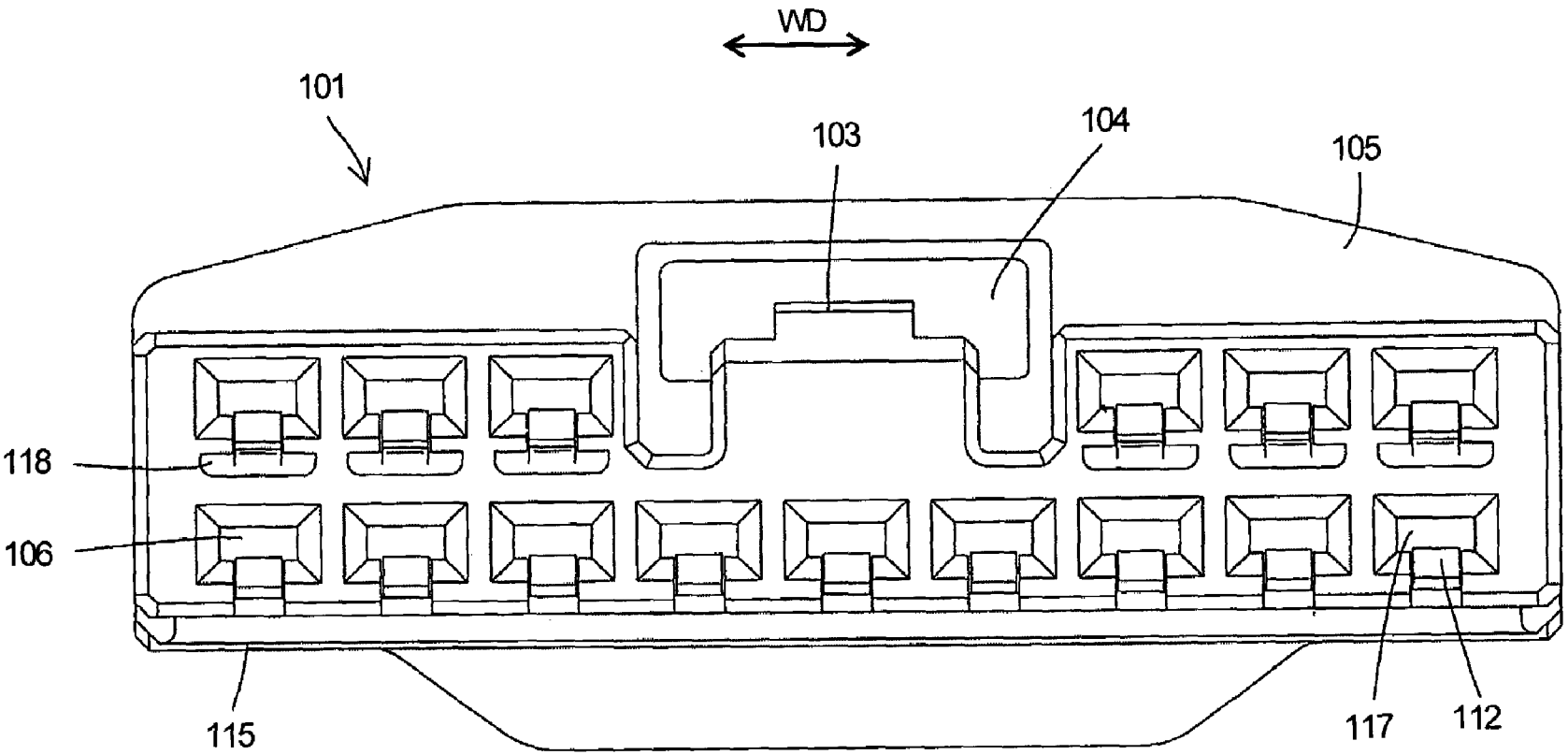
FIG. 20 is a front view of a female connector housing.
Figure 21:
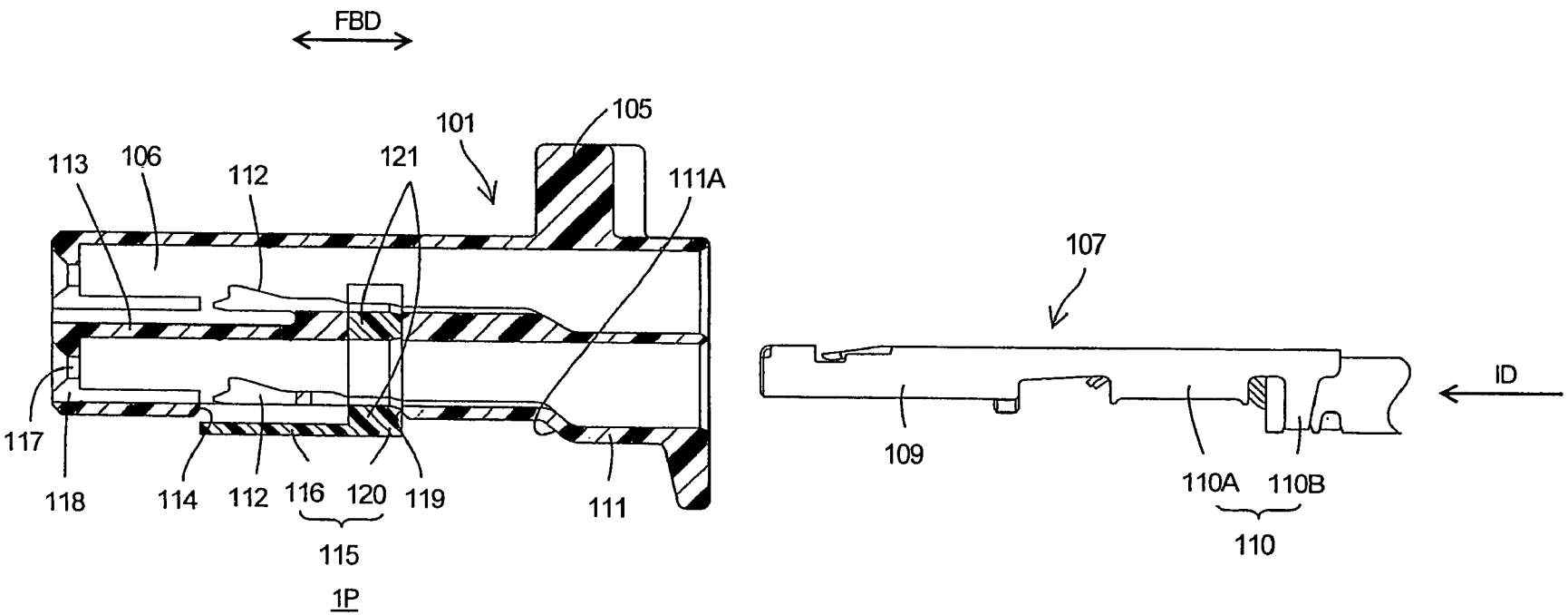
FIG. 21 is a side view in section of the female connector housing when a retainer is at a partial locking position.
Figure 22:
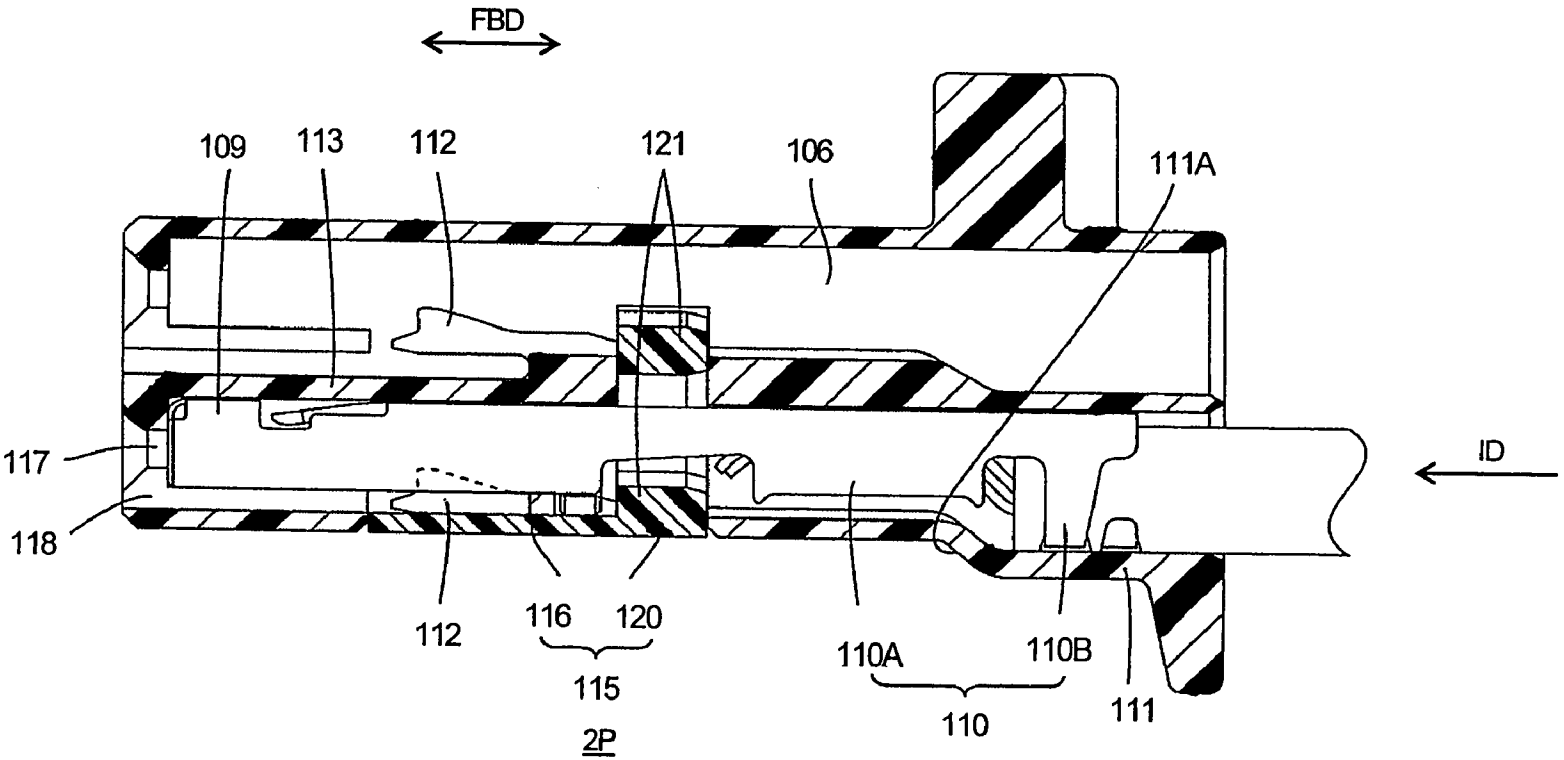
FIG. 22 is a side view in section of the female connector housing when the retainer is at a full locking position.

The jig J could not be inserted easily if the tab insertion openings 60 were not enlarged, as shown in FIG. 19. However, the opening forming member 40' can be displaced to widen the jig insertion openings 52, as shown in FIG. 15. Thus, the jig J is inserted more easily. On the other hand, the jig insertion openings 52 can be narrowed by moving the opening forming member 40' when the jig J need not be inserted. Thus external matter is not likely to enter through the jig insertion openings 52.

The terminal locking portions 45A, 45B on the opening forming member 40' engage and retain the terminal fittings 30 when the opening forming member 40' is at the full locking position 2P that narrows the jig insertion openings 52. The terminal locking portions 45A, 45B retract to positions disengaged from the terminal fittings 30 when the opening forming member 40' is at the partial locking position 1P that widens the jig insertion openings 52. In other words, the terminal locking portions 45A, 45B move between positions to engage the terminal fittings 30 and positions to disengage from the terminal fittings 30 as the opening forming member 40' is displaced. Thus, it is not necessary to separately displace the opening forming member 40' and then to move the terminal locking portions 45A, 45B. Therefore, operability is better.

The opening forming member 40' is displaced to the partial locking position 1P and narrows the jig insertion openings 52 when it is not necessary to withdraw the terminal fitting 30. Thus, the locks 15B cannot deform towards the deformation spaces 21B and the reliability of retaining the terminal fittings 30 is higher.

A third embodiment of the invention is illustrated in FIGS. 20 to 29 and includes a female housing 101. A resiliently deformable lock arm 103 is cantilevered rearwardly from the widthwise center of the upper surface of the female housing 101 and is configured to hold the female housing 101 connected with a male housing 102. An unlocking portion 103A is provided at the rear end of the lock arm 103 and a protection wall 105 stands at the rear edge of the upper surface of the female housing 101 over substantially the entire width. A window 104 is formed in a widthwise middle of the protecting wall 105 and the unlocking end 103A of the lock arm 103 is introduced through the window 104 for operation.

Cavities 106 are formed substantially side by side along the width direction at two stages in the female housing 101. The cavities 106 penetrate the female housing 101 in forward and backward directions FBD, and female terminal fittings 107 can be inserted into the cavities 106 from behind and along an inserting direction ID.

Each female terminal fitting 107 includes a rectangular tube 109 to be connected with a male terminal fitting 8 and a barrel 110 behind the rectangular tube 109. The barrel 110 includes a wire barrel 110A to be crimped, bent or folded into connection with a core of the wire and an insulation barrel 110B to be crimped, bent or folded into connection with an insulation coating of the wire. The female terminal fitting 107 is connected with the wire, and the height from the bottom surface of the female terminal fitting 107 to the top end of the wire barrel 110A is shorter than the height of the rectangular tube 109, but the height to the top end of the insulation barrel 110B is taller than the height of the rectangular tube 109.

The height inside each cavity 106 is changed to correspond to the height of the insulation barrel 110B, which is taller than the height of the rectangular tube 109. Thus, an outward bulge 111 extends across the entire width of the bottom surface of the female housing 101 at a part corresponding to the barrels 110.

A lock 112 cantilevers forward from the bottom wall of each cavity 106. The lock 112 is resiliently deformable along a height direction in a direction substantially intersecting the inserting direction ID of the female terminal fitting 107 into the cavity 106. The lock 112 is engageable with a locking hole, recess or step (not shown) in the rectangular tube 109 of the female terminal fitting 107. Deformation spaces for the locks 112 are defined in the cavities 106 at the upper stage, and partition walls 113 between the upper and lower cavities 106 prevent excessive deformations of the locks 112. More particularly, the leading end of the lock 112 contacts the partition wall 113 before the lock 112 reaches its resiliency limit to prevent any further resilient deformation. However, a bore 114 is formed at a part of the outer surface of the female housing 101 corresponding to the locks 112. Thus, the locks 112 in the cavities 106 at the lower stage are exposed at the outer surface of the female housing 101 over substantially the entire length. More specifically, the lower surface of each lower stage lock 112 is substantially flush with the bottom surface of the cavity 106 when the lock 112 is in an unbiased state. However, at least the leading end of the lock 112 projects out from the cavity 106 when the lock 112 is deformed down in a direction intersecting the inserting direction ID as the female terminal fitting 107 passes.

Tab insertion openings 117 are formed in the front wall of the housing 101 and communicate with the cavities 106. Thus, tabs of the male terminal fittings 108 mounted in the male housing 102 can be inserted through the tab insertion openings 117 upon connecting the male and female housings 102, 101. Jig insertion openings 118 are formed in the front wall of the female housing 101 and communicate with the bottom ends of the tab insertion openings 117. An unlocking jig can be inserted through the jig insertion openings 118 to deform the locks 112 in unlocking direction.

A retainer mount hole 119 is formed in an intermediate portion of the bottom surface of the female housing 101 behind the locks 112 and communicates with the cavities 106 at the upper and lower stages.

The retainer 115 is formed unitarily e.g. of a synthetic resin similar to the female connector housing 101. The retainer 115 has a terminal locking portion 120 engageable with the female terminal fittings 107 and an excessive deformation preventing portion 116 for protecting the locks 112 and preventing excessive deformation of the locks 112. The terminal locking portion 120 fits into the retainer mount hole 119 and has locking projections 121 at positions corresponding to the respective cavities 106. The locking projections 121 are retracted from the cavities 106 when the retainer 115 is at a partial locking position 1P (see FIGS. 21 and 27) to permit insertion and withdrawal of the respective terminal fittings 107 into and from the cavities 106. However, the locking projections 121 project into the cavities 106 to engage the rear ends of the rectangular tubes 109 of the female terminal fittings 107 when the retainer 115 is at a full locking position 2P (see FIGS. 22 and 28).

Side plates 122 are provided at the opposite widthwise sides of the terminal locking portion 120. The length of the side plates 122 is slightly longer than a longitudinal dimension of a sum of the terminal locking portion 120 and the excessive deformation preventing portion 116 extending substantially forward from the terminal locking portion 120. The side plates 122 can deform in directions away from each other only to a slight extent, and thereby tightly hold the opposite side surfaces of the female housing 101 from opposite outer sides. A locking groove 123 is formed in the inner surface of each side plate 122 at a position near the leading upper end. Partial and full locking projections 124 and 125 are formed on each outer side surface of the female housing 101 and extend substantially horizontally while defining a clearance above the partial locking projection 102. When the retainer 115 is at the partial locking position 1P, only the partial locking projections 124 fit in the locking grooves 123 and engage the upper edges of the locking grooves 123. Additionally, the upper edges of the side plates 122 engage the full locking projections 125 to hold the entire retainer 115 at the partial locking position 1P to restrict vertical movements. On the other hand, when the retainer 115 is at the full locking position 2P, the partial locking projections 124 and the full locking projections 125 are fit in the locking grooves 123 and engage the opposite lower and upper edges of the locking grooves 123 so that the entire retainer 115 is held at the full locking position and is restricted to make vertical movements.

The excessive deformation preventing portion 116 has substantially the same width as the terminal locking portion 120 and extends forward substantially parallel with the bottom surface of the female housing 101 to define a specified clearance to the locking portions 112 when the retainer 115 is at the partial locking position 1P. Specifically, the clearance ensures a degree of resilient deformations of the locks 112 necessary for the passage of the female terminal fittings 107 as described above. When the lock 112 is deformed within its resiliency limit, the leading end of the lock 112 contacts or comes very close the upper surface of the excessive deformation preventing portion 116. When the retainer 115 is moved to the full locking position 2P, the excessive deformation preventing portion 116 fits into the bore 114 of the female housing 101, and the lower surface of the excessive deformation preventing portion 116 and the bottom surface of the female housing 101 become substantially flush with each other. When the retainer 115 is at the full locking position 2P, the upper surface of the excessive deformation preventing portion 116 substantially contacts the lower surfaces of the locks 112 to prevent deformations of the locks 112 in the unlocking direction.

Figure 29:
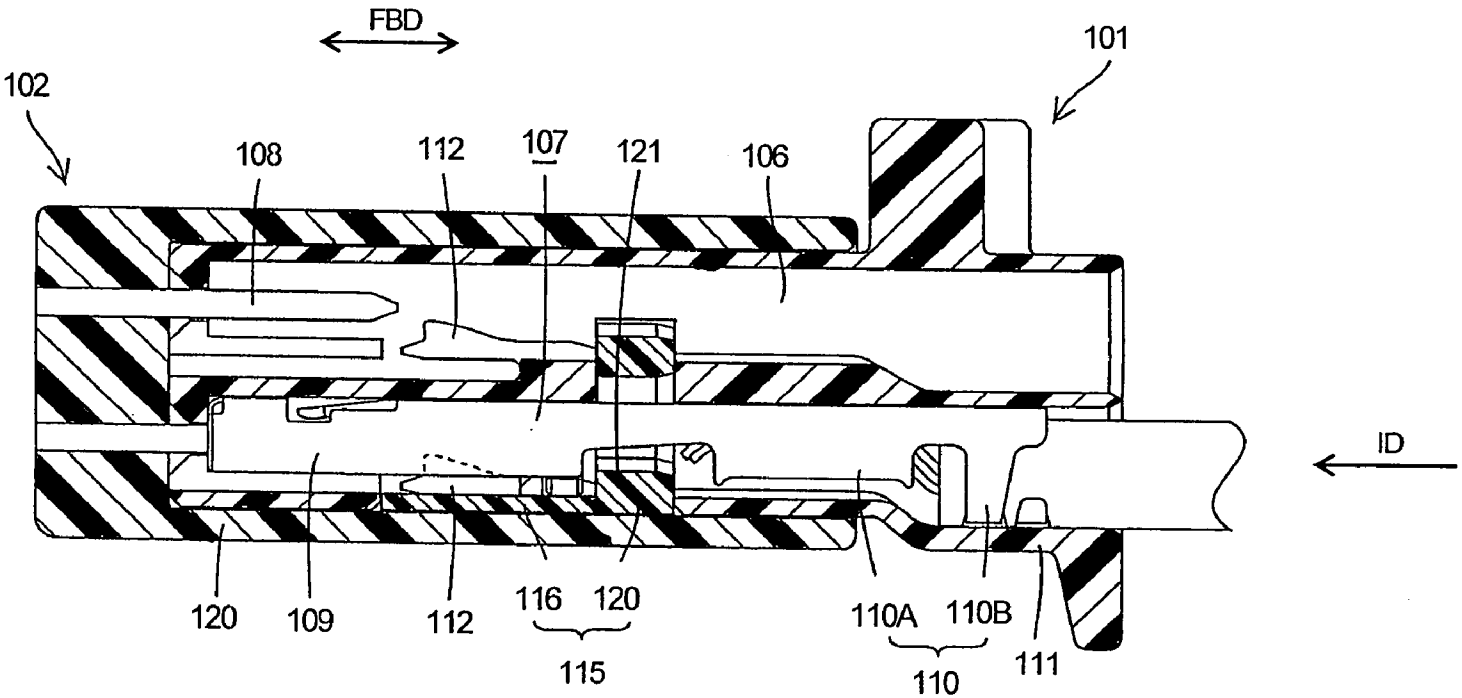
FIG. 29 is a side view in section showing a state where male and female connector housings are connected.

As shown in FIG. 29, the male housing 102 includes a receptacle 126 for receiving the female housing 101, and male terminal fittings 108 project into the receptacle for connection with the female terminal fittings 107 when the male and female housings 102, 101 are connected.

Figure 23:
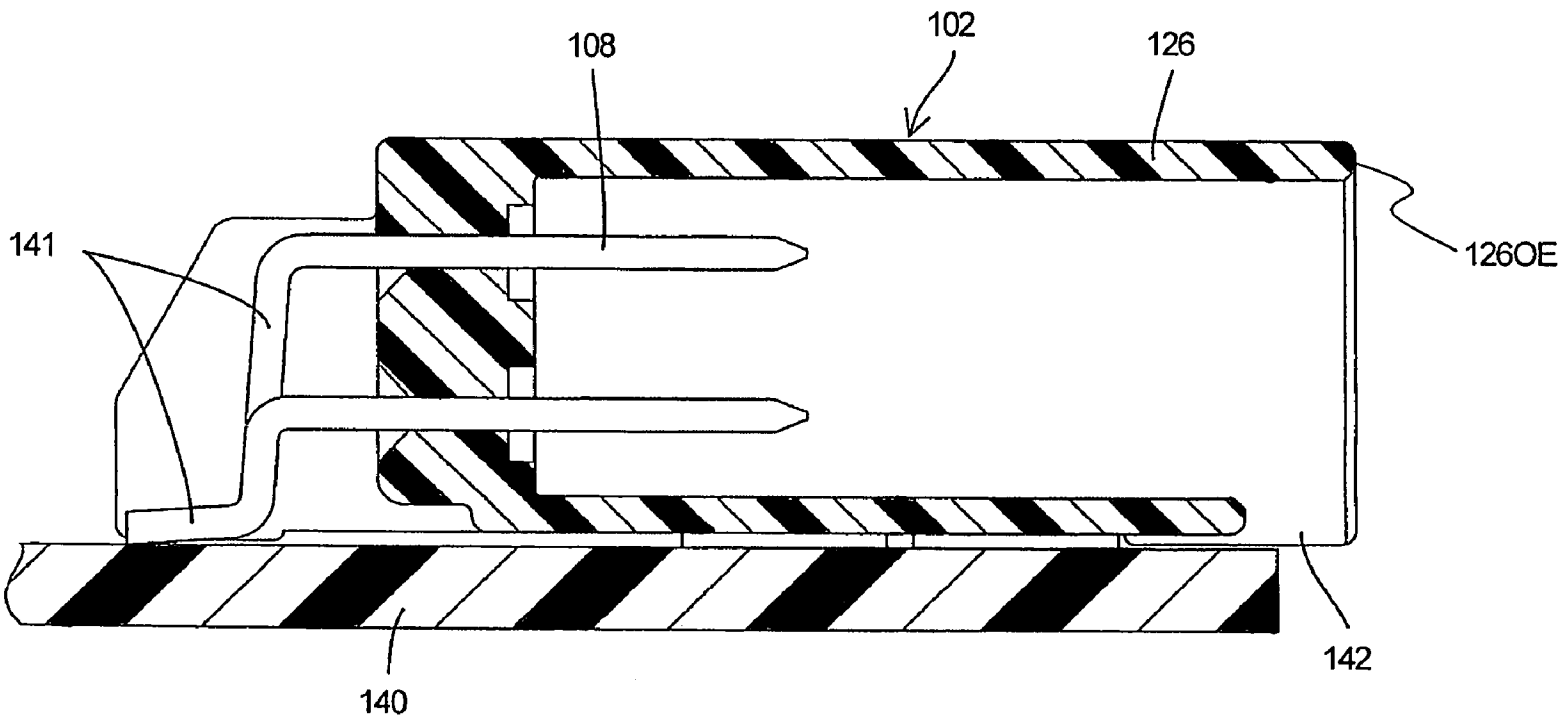
FIG. 23 is a side view in section of a male connector housing.

As shown in FIG. 23, the male housing 102 may be mounted on a printed circuit board 140. The rear end of each male terminal fitting 108 is bent twice to define a crank-shape and defines a lead 141 that projects out from the male housing 102. The respective leads 141 are connected with conductor paths (not shown) of the printed circuit board 140 by soldering, welding, press fitting, insulation displacement, reflow soldering or the like. An escaping portion 142 is formed over substantially the entire width of the male housing 102 at a part of an opening edge 126OE of the receptacle 126 of the male housing 102 corresponding to the bulge 111. It should be noted that the opening edge portion 126OE of the receptacle 126 projects slightly forward from the front end of the printed circuit board 140 in this embodiment.

Figure 24:
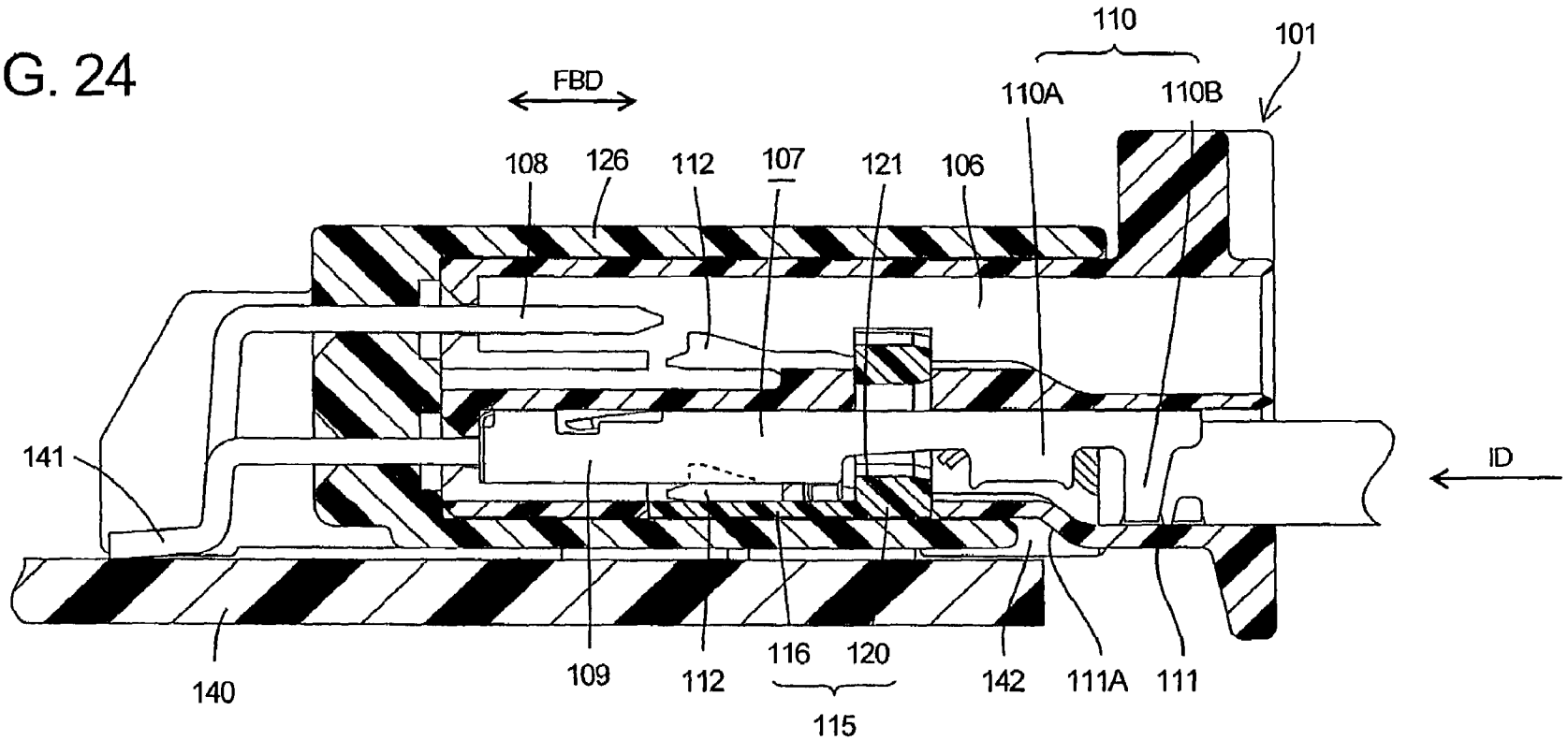
FIG. 24 is a side view in section showing a connected state of the male and female connector housings.
Figure 25:
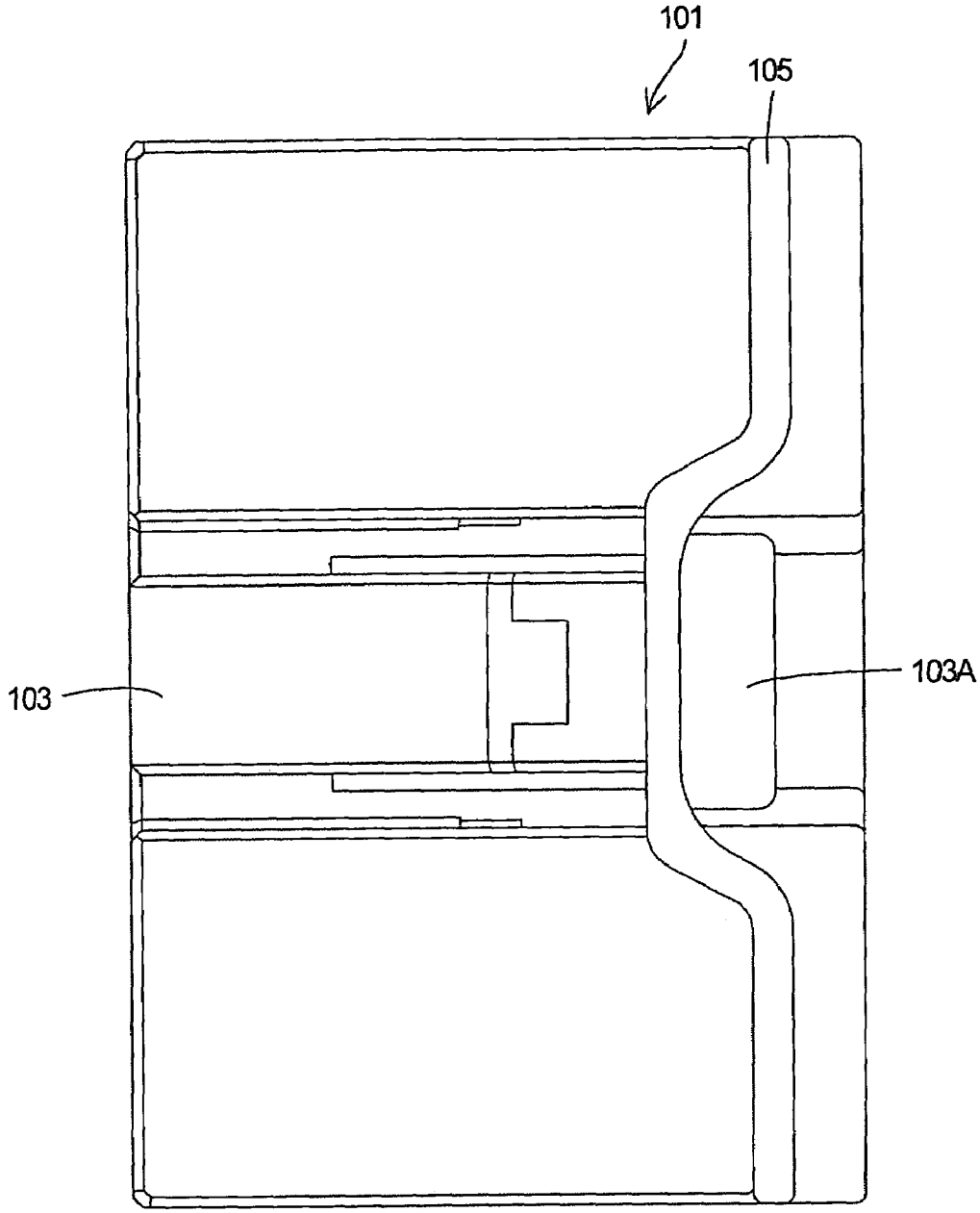
FIG. 25 is a plan view of the female connector housing.
Figure 26:
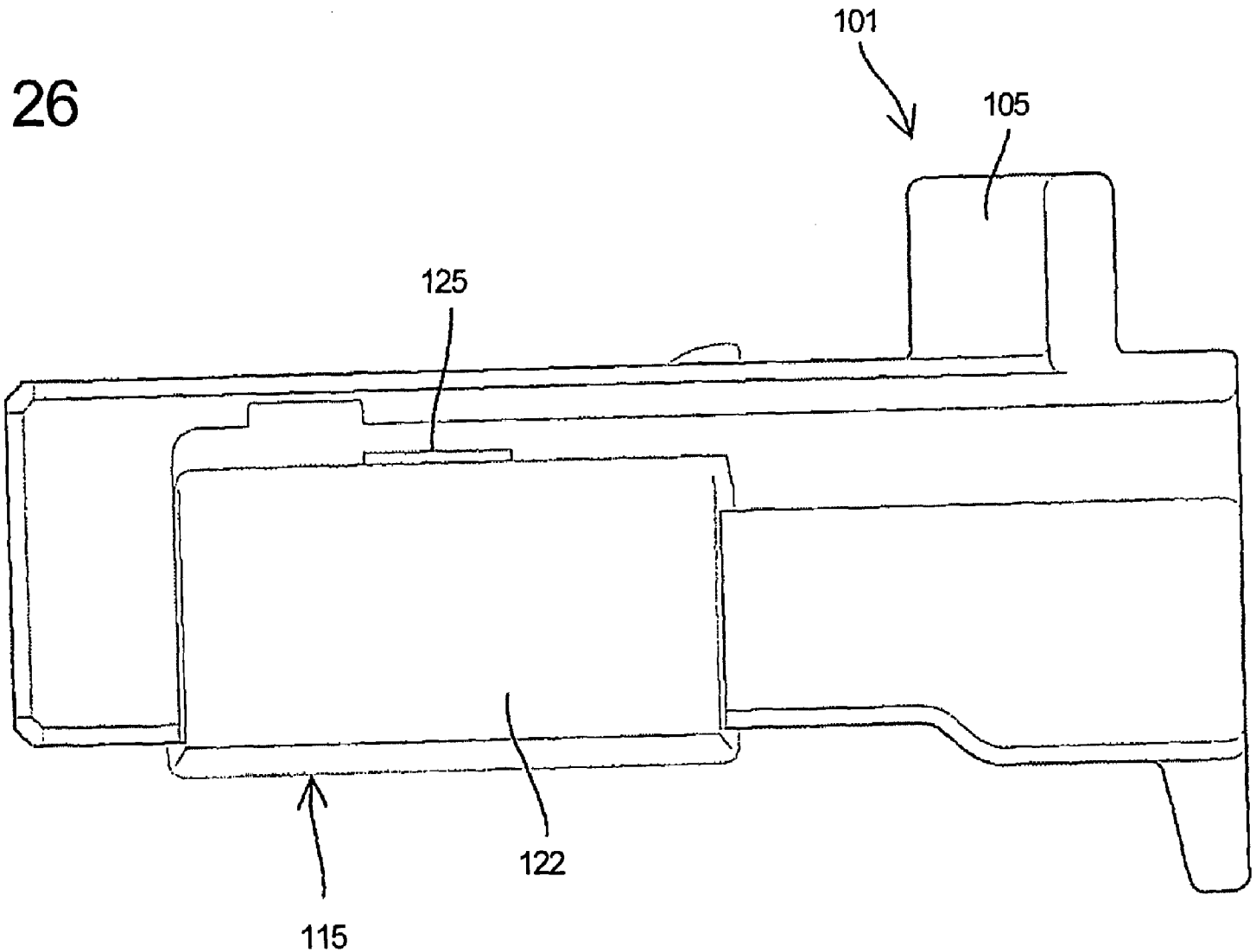
FIG. 26 is a side view of the female connector housing.
Figure 27:
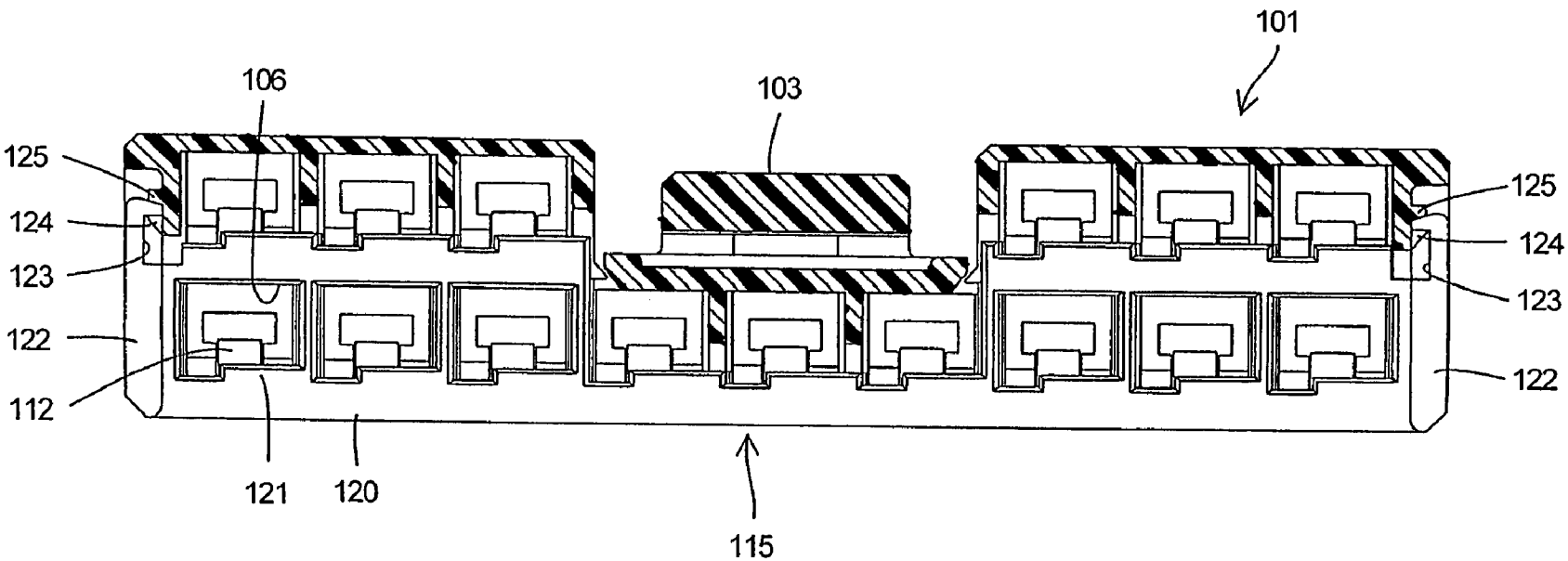
FIG. 27 is a front view in section of the female connector housing when the retainer is at the partial locking position.
Figure 28:
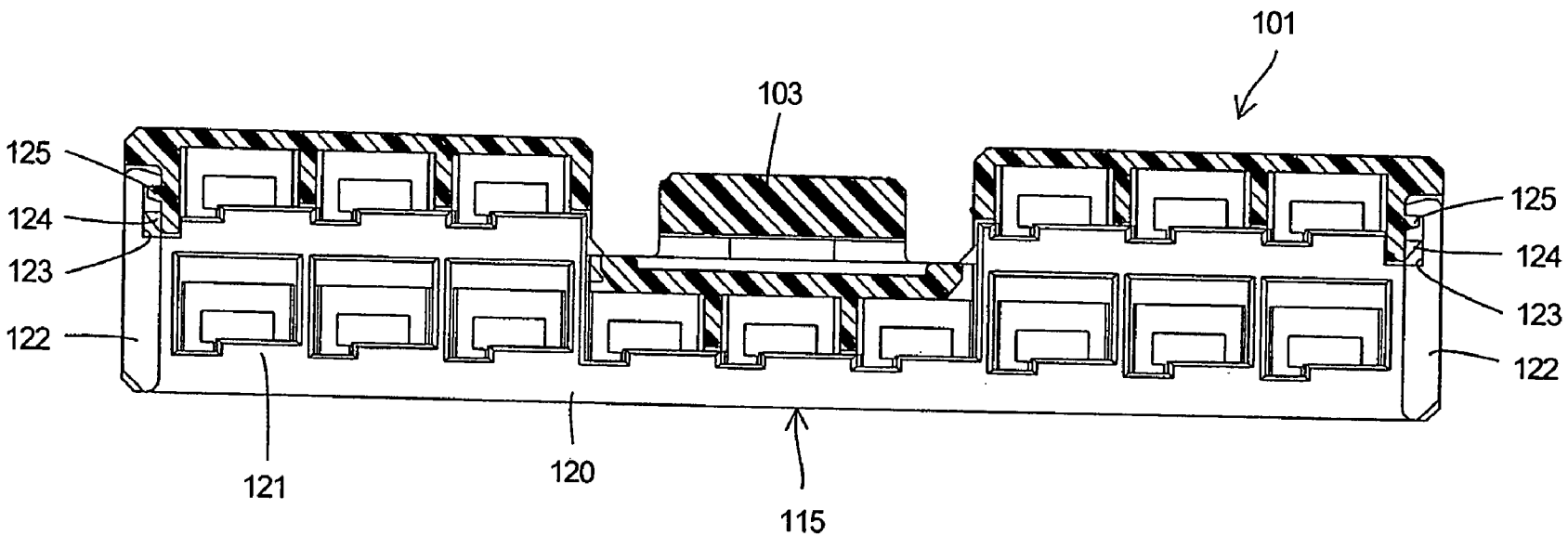
FIG. 28 is a front view in section of the female connector housing when the retainer is at the full locking position.

The opening edge portion 126OE of the receptacle 126 substantially reaches the frontmost end of the protection wall 105 when the male and female housings 102, 101 are connected, and a part of the front side of the bulge 111 is fit into the escaping portion 142 at this time. As shown in FIG. 24, a step 111A of the bulge 111 of the female housing 101 has a vertical dimension substantially equal to the thickness of the receptacle 126. At the step 111A, the female connector housing 107 is enlarged in a vertical direction that is substantially normal to the inserting direction ID and in a direction lying in a plane containing the deformation direction of the lock 112. Thus, the outer surfaces of the receptacle 126 and the bulge 111 are substantially flush with each other when the male and female housings 102, 101 are connected.

The retainer 115 is held at the partial locking position 1P in the female connector housing 101, and the female terminal fittings 107 are inserted in the inserting direction ID into each cavity 106. The lock 112 deforms resiliently out and down in a direction intersecting the inserting direction ID as the female terminal fitting 107 passes and is restored resiliently to engage the unillustrated locking hole, recess or step of the female terminal fitting 107 when the female terminal fitting 107 is inserted to a proper depth. The retainer 115 then is pushed further into the female housing 101. As a result, the upper edges of both side plates 122 move over the full locking projections 125 and the full locking projections 125 fit into the locking grooves 123. In this way, the retainer 115 is held at the full locking position 2P. At this position, the respective locking projections 121 engage the rear ends of the rectangular tubes 109 of the corresponding female terminal fittings 107 and the excessive deformation preventing portion 116 substantially contacts the lower surfaces of the locks 112. Thus, the female terminal fittings 107 are retained securely by the locking projections 121 and the excessive deformation preventing portion 116.

The male and female housings 102, 101 can be connected after the female terminal fittings 107 are mounted into the female connector housing 101. The lock arm 103 on the male housing 102 engages an unillustrated engaging portion when the female housing 101 is inserted into the receptacle 126 of the male housing 102 to lock the two housings 101, 102 together.

In this embodiment, the outer surfaces of the female housing 101 are stepped to form the bulge 111 to accommodate the height difference between the insulation barrels and the rectangular tubes 109 of the female terminal fittings 107. Thus, a shorter part of the female housing 101 before the bulge 111 can be fit into the receptacle 126 of the male housing 102. Thus, the height of the connector is shortened as compared to a case where the outer surfaces of the female housings 101 are formed substantially in conformity with the height of the barrels 110.

In addition, since the part of the bulge 111 is fit into the escaping portion 142 of the receptacle 126, the entire length of the connector can be shortened at least by the dimension of the bulge 111 fit in the escaping portion 142. In other words, the entire connector can be miniaturized by shortening the length as well as the height while maintaining a good operability.

Furthermore, the locks 112 in the cavities 106 at the lower stage are exposed at the outer surface of the female housing 101 to miniaturize the height of the connector. Deformation of the lock 112 is not restricted by the female housing 101 if an external force is exerted on the lock 112 when the retainer 115 is at the partial locking position 1P. However, resilient deformation beyond the resiliency limit is prevented by the contact with the excessive deformation preventing portion 116 of the retainer 115 even if the lock 112 receives an external force. Thus, the function of the lock 112 is assured. Accordingly, such a construction is quite significant and advantageous to shorten the height. Further, by forming the excessive deformation preventing portion 116 on the existing structure, namely, the retainer 115, there are additional effects of being unnecessary to provide a member exclusively used to prevent the excessive deformation and simplifying the construction.

Figure 30:
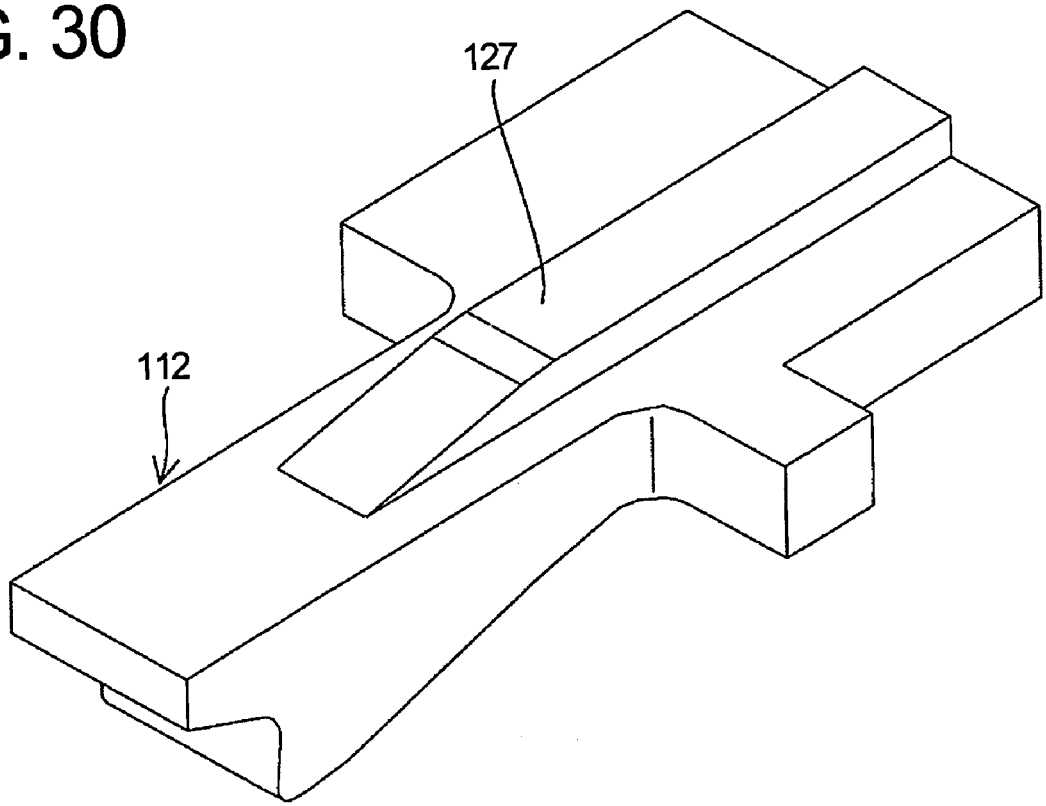
FIG. 30 is a perspective view showing a locking portion according to a fourth embodiment with the locking portion turned upside down.
Figure 31:
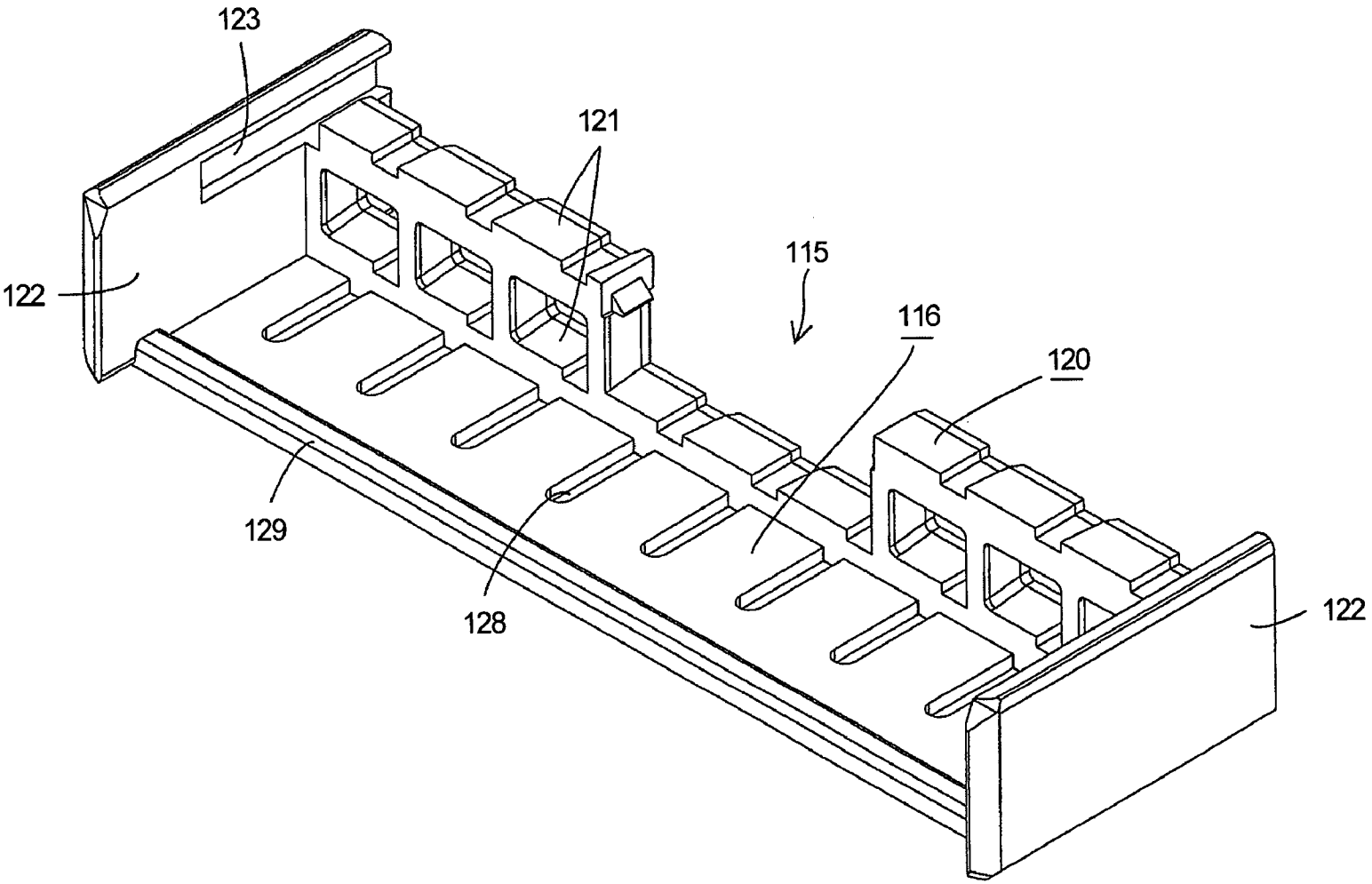
FIG. 31 is a perspective view of a retainer according to the fourth embodiment.
Figure 32:
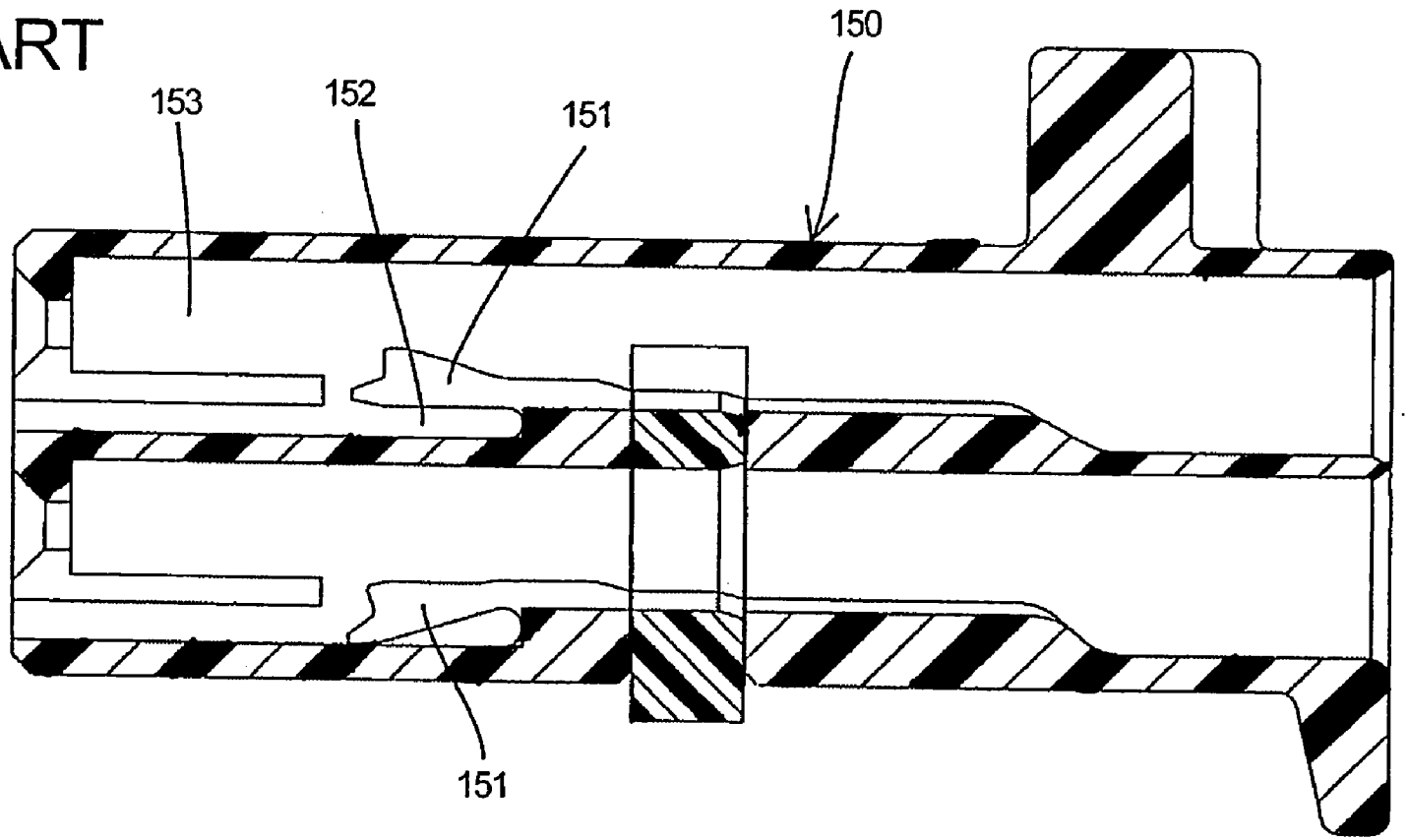
FIG. 32 PRIOR ART
FIG. 32 is a side view in section showing a prior art connector.

A fourth embodiment of the invention is described with reference to FIGS. 30 and 31. As the miniaturization of the female connector housing 101 progresses, the locks 112 also are thinned, resulting in a reduction in the locking forces to lock the female terminal fittings 107. In the fourth embodiment, the rigidity of the locks 112 is increased as a countermeasure. Specifically, at least one longitudinally-extending reinforcing rib 127 projects in a widthwise intermediate position of the lower surface of each lock 112.

The reinforcing ribs 127 on the locks 112 must not interfere with the excessive deformation preventing portion 116. Thus, the excessive deformation preventing portion 116 is formed with escaping slits, recesses or steps 128 at positions corresponding to the respective reinforcing ribs 127. Part of the reinforcing rib 127 enters the corresponding slit 128 if the lock 112 undergoes a resilient deformation when the retainer 115 is at the partial locking position 1P. The reinforcing ribs 127 also are in the slits 115 when the retainer 115 is at the full locking position 2P.

The slits 128 may reduce the strength of the excessive deformation preventing portion 116 of the fourth embodiment. However, a reinforcing edge 129 is formed at the front of the upper surface of the excessive deformation preventing portion 116 over substantially the entire width.

Deformation of the excessive deformation preventing portion 116 is avoided in the second embodiment, and the excessive deformation preventing portion 116 fulfill its functions.

Further constructions of the fourth embodiment may be substantially identical or similar to the above first and second preferred embodiments.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The protecting member has the wall facing the deformation spaces in certain illustrated embodiments. However, the wall facing the deformation spaces may be integral or unitary to the housing.

The escaping portions penetrate the wall in certain illustrated embodiments, but they may be recesses without penetrating the wall.

The wall contacts locks to prevent the resilient deformations of the locks towards the deformation spaces when the protecting member is at the full locking position. However, the wall may not contact the locks and may permit deformations of the locks towards the deformation spaces with the protecting member at the full locking position.

Although the protecting member has the terminal locks, the protecting member may have no terminal locks.

The protecting member can be held at the partial locking position, where the insertion of the terminal fittings is permitted, and at the full locking position where the terminal fittings are retained in the housing in the foregoing embodiment. However, the protecting member may be held only at the full locking position according to the invention.

Although the terminal fittings are female terminal fittings in the foregoing embodiments, the invention is applicable to male terminal fittings.

The reinforcing portion projects at the front end of the wall in certain foregoing embodiments, but may be omitted.

The reinforcing ribs are not in the escaping portions when the locks are deformed resiliently in certain embodiments. However, they may be in the escaping portions with the locks resiliently deformed.

The above-described connectors have cavities at two stages. However, the invention is applicable to connectors having one or more cavities arranged in one stage or in three or more stages.

The opening forming member contacts the locks to prevent resilient deformations of the locks towards the deformation spaces when the opening forming member is displaced to a position to narrow the jig insertion openings. However, the opening forming member need not contact the locks and may permit the locks to deform resiliently towards the deformation spaces when the opening forming member is displaced to narrow the jig insertion openings.

The opening forming member has terminal locking portions for retaining the terminal fittings by entering the terminal cavities and being engaged with the terminal fittings. However, the opening forming member may be provided with no terminal locking portion according to the invention.

The locks are thinned with the miniaturization of the female connector housing and may not be sufficiently strong. As a countermeasure, reinforcing ribs (see e.g. ribs 18, 20, 127) may be formed on the lower surfaces of the locks.

The excessive deformation preventing portion 116 of the retainer 115 may have escaping holes or recesses for the reinforcing ribs. This can avoid the interference of the reinforcing ribs and the excessive deformation preventing portion 116 even if the locks 112 are deformed when the retainer 115 is at the partial locking position 1P. Such interference also can be avoided when the retainer 115 is at the full locking position 2P.

A reinforcing edge may be formed, for example, at the leading end of the excessive deformation preventing portion 116 since the strength of the excessive deformation preventing portion 116 is reduced.

The above-described the locks 112 are cantilevered. However, the locks may be bridge-shaped with support at both ends and an intermediate portion that deformable in a direction intersecting the inserting direction ID.

The excessive deformation preventing portion has a length substantially equal to the length of the locks in the above embodiments. However, the excessive deformation preventing portion can have other dimensions provided that it can fulfill the function of preventing excessive deformations. The excessive deformations of the locks can be prevented even if the excessive deformation preventing portion has such a length to contact the base ends of the locks.

The excessive deformation preventing portion has a length substantially equal to the length of the locks in the foregoing embodiments. However, the locks can be covered partly from outside to avoid contact by external matter.

Thus, the excessive deformation preventing portion can be dimensioned to also function as a protection for the locks.

In the third and fourth embodiments, the excessive deformation preventing portion substantially contacts the lower surfaces of the locks to prevent the locks from being deformed in unlocking direction when the retainer is at the full locking position. However, the excessive deformation preventing portion need not always be in contact with the lower surfaces of the locks.

The reinforcing edge is applied to the retainer with the escaping slits formed in the excessive deformation preventing portion in the fourth embodiment. However, the retainer may have no slit.

What is claimed is:

1. A connector, comprising:

a housing with at least one cavity and a deformation space substantially adjacent the cavity;

at least one terminal fitting insertable into the cavity;

at least one resiliently deformable lock extending substantially along an inner wall of the cavity, the lock being deformed towards the deformation space due to interference with the terminal fitting as the terminal fitting is inserted into the cavity, the lock being restored resiliently to engage the terminal fitting and to retain the terminal fitting when the terminal fitting is inserted properly;

at least one reinforcing rib projecting from a surface of the lock substantially facing the deformation space; and at least one escaping portion formed in a wall substantially facing the deformation space and at a position substantially facing the lock for accommodating the reinforcing rib.

2. The connector of claim 1, wherein the escaping portion penetrates the wall.

3. The connector of claim 1, wherein the deformation space makes an opening in an outer surface of the housing, a protector having the wall substantially facing the deformation space and the escaping portion being mounted to the opening of the deformation space in the outer surface of the housing, and the wall enters a deformation area for the lock in the deformation space when the protector is mounted.

4. The connector of claim 3, wherein the wall contacts the lock to prevent deformation of the lock towards the deformation space when the protector is mounted to the housing.

5. The connector of claim 4, wherein the protector includes a terminal lock for retaining the terminal fitting by entering the cavity and engaging the terminal fitting.

6. A connector, comprising:

a housing with at least one cavity and a deformation space substantially adjacent the cavity;

at least one terminal fitting insertable into the cavity;

at least one resiliently deformable lock extending substantially along an tinner wall of the cavity, the lock being deformed towards the deformation space due to interference with the terminal fitting as the terminal fitting is inserted into the cavity, the lock being restored resiliently to engage the terminal fitting and to retain the terminal fitting when the terminal fitting is inserted properly; and a jig insertion opening being formed in a front wall of the housing for receiving a jig for disengaging the lock from the terminal fitting, an area of the edge of the jig insertion opening corresponding to the deformation space being formed by an opening forming member separate from the housing and displaceable relative to the housing in a direction as to widen the jig insertion opening.

7. The connector of claim 6, wherein the opening forming member includes a terminal lock for entering the cavity, the terminal lock being engaged with the terminal fitting to retain the terminal fitting when the opening forming member is at a position to narrow the jig insertion opening and the terminal lock being disengaged from the terminal fitting when the opening forming member is at a position to widen the jig insertion opening.

8. The connector of claim 6, wherein the opening forming member contacts the lock to prevent the deformation of the lock towards the deformation space while at a position to narrow the jig insertion opening.

9. The connector of claim 6, wherein the deformation space makes an opening in an outer surface of the housing, the opening forming member having a wall substantially facing the deformation space, and at least one escaping portion formed in the wall substantially facing the deformation space and at a position substantially facing the lock, the wall entering a deformation area for the lock in the deformation space when the opening forming member is mounted.

10. A connector assembly, comprising:

at least one terminal fitting with a terminal connecting portion for connection with a mating terminal fitting and a wire connection portion behind the terminal connecting portion for connection with a wire and being cross-sectionally larger height from a lateral surface than the terminal connecting portion, a first housing for accommodating the terminal fitting, a bulge formed at the outer surfaces of the first housing at a part for accommodating the wire connection portion, and bulging out from a part of the first housing for accommodating the terminal connecting portion via a an enlarging portion, and a second housing including a receptacle for receiving the first housing, wherein an escaping portion is formed at an opening edge of the receptacle of the second housing for receiving the bulge when the two housings are connected.

11. The connector assembly of claim 10, wherein a surface of the receptacle where the escaping portion is formed is substantially flush with an outer surface of the bulge when the two housings are connected.

12. The connector assembly of claim 10, wherein the escaping portion penetrates the wall of the opening edge of the receptacle in a thickness direction.

13. The connector assembly of claim 10, wherein the bulge has a vertical dimension substantially equal to the thickness of the receptacle.

14. A connector, comprising:

a housing with at least one cavity for receiving at least one terminal fitting, at least one lock least partly exposed at a side surface of the housing and engageable with the terminal fitting while being resiliently deformed outward of the side surface of the housing, and a retainer mountable to the housing and being movable between a first position where the terminal fitting is insertable into and withdrawable from the cavity and a second position where the retainer engages and retains the terminal fitting, the retainer including a terminal lock for locking the terminal fitting and an excessive deformation preventing portion at a resiliently deforming side of the lock for preventing excessive deformation of the lock when the retainer is at the first position.

15. The connector of claim 14, wherein the retainer includes a lock protecting portion extending from the terminal lock substantially along the outer exposed surface of the lock to cover the outer exposed surface.

16. The connector of claim 15, wherein the excessive deformation preventing portion is formed to cover the lock substantially along a longitudinal direction of the lock.

17. The connector of claim 16, wherein the excessive deformation preventing portion and the lock protecting portion are in a resiliently deforming area of the lock to prevent deformation of the lock when the terminal lock of the retainer is engaged with the terminal fitting.

18. The connector of claim 17, wherein the excessive deformation preventing portion and the lock protecting portion are formed with a reinforcement.

* * * * *